US011214086B2

(12) United States Patent
Tanaka et al.

(10) Patent No.: US 11,214,086 B2
(45) Date of Patent: Jan. 4, 2022

(54) INKJET RECORDING APPARATUS

(71) Applicant: CANON KABUSHIKI KAISHA, Tokyo (JP)

(72) Inventors: Yusuke Tanaka, Kawasaki (JP); Koki Shimada, Kawasaki (JP); Masateru Komori, Yokohama (JP); Yuta Araki, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 16/833,245

(22) Filed: Mar. 27, 2020

(65) Prior Publication Data

US 2020/0316969 A1 Oct. 8, 2020

(30) Foreign Application Priority Data

Apr. 5, 2019 (JP) ..... JP2019-072549
Apr. 5, 2019 (JP) ..... JP2019-072550

(51) Int. Cl.
*B41J 25/00* (2006.01)
*B41J 2/165* (2006.01)
*B41J 2/175* (2006.01)

(52) U.S. Cl.
CPC ..... *B41J 25/006* (2013.01); *B41J 2/16508* (2013.01); *B41J 2/16535* (2013.01); *B41J 2/1752* (2013.01)

(58) Field of Classification Search
CPC .. B41J 25/006; B41J 2/16508; B41J 2/16535; B41J 2/1752; B41J 2/16517; B41J 2/17513; B41J 2/1714; B41J 2/17546; B41J 2/17543; B41J 2/17523; B41J 2/175; B41J 2/17553; B41J 2/17536; B41J 2/17509; B41J 29/13; B41J 2002/17573;

(Continued)

(56) References Cited

U.S. PATENT DOCUMENTS 5,367,328 A * 11/1994 Erickson ..... B41J 2/17566 347/7
5,638,097 A * 6/1997 Takayanagi ..... B41J 25/34 347/7

(Continued)

FOREIGN PATENT DOCUMENTS

CN 1891472 A 1/2007
CN 101066642 A 11/2007

(Continued)

*Primary Examiner* — Huan H Tran
*Assistant Examiner* — Alexander D Shenderov
(74) *Attorney, Agent, or Firm* — Canon U.S.A., Inc. I.P. Division

(57) ABSTRACT

An inkjet recording apparatus configured to perform recording operation by ejecting ink at least from a first recording head, includes an ink tank configured to contain the ink to be supplied to the first recording head, a tube configured to connect the first recording head and the ink tank, and a carriage including a first mounting portion on which the first recording head is mounted, a second mounting portion on which a second recording head is detachably mounted, and a contact portion electrically connected to the second recording head, and configured to reciprocate. A protection member protecting the contact portion can be detachably mounted on the second mounting portion.

16 Claims, 19 Drawing Sheets

(58) Field of Classification Search
CPC . B41J 2/17566; B41J 29/02; B41J 2/01; B41J 2/21; B41J 2/145
USPC ..... 347/29
See application file for complete search history.

(56) References Cited

U.S. PATENT DOCUMENTS

| | | | | |
|---|---|---|---|---|
| 6,220,697 | B1 * | 4/2001 | Yamanaka | B41J 2/14024 347/63 |
| 6,244,683 | B1 | 6/2001 | Alvarez | |
| 9,387,681 | B2 | 7/2016 | Somano | |
| 9,469,120 | B2 | 10/2016 | Hara | |
| 9,914,304 | B2 * | 3/2018 | Shirotori | B41J 2/17503 |
| 2001/0012026 | A1 * | 8/2001 | Kobayashi | B41J 11/0095 347/19 |
| 2003/0107625 | A1 | 6/2003 | Koga | |
| 2007/0279464 | A1 | 12/2007 | Harazim | |
| 2012/0081422 | A1 * | 4/2012 | Kura | G01F 23/00 347/6 |
| 2013/0044161 | A1 | 2/2013 | Somano | |

FOREIGN PATENT DOCUMENTS

| | | | |
|---|---|---|---|
| CN | 101284451 | A | 10/2008 |
| CN | 101362405 | A | 2/2009 |
| CN | 101642983 | A | 2/2010 |
| CN | 102602154 | A | 7/2012 |
| CN | 102756563 | A | 10/2012 |
| CN | 104723679 | A | 6/2015 |
| JP | 9-76537 | A | 3/1997 |
| JP | 2002-292904 | A | 10/2002 |
| JP | 2006326912 | A | 12/2006 |
| JP | 2012152996 | A | 8/2012 |

* cited by examiner

SIDE VIEW IN CAPPING STATE

FRONT VIEW IN CAPPING STATE
(WIPER NOT ILLUSTRATED)

FRONT VIEW IN CAPPING STATE
(CAP NOT ILLUSTRATED)

INKJET RECORDING APPARATUS

BACKGROUND OF THE INVENTION

Field of the Invention

The present invention relates to an inkjet recording apparatus that records an image by ejecting ink.

Description of the Related Art

Japanese Patent Application Laid-Open No. H9-76537 discusses an inkjet recording apparatus in which black ink high in printing frequency is supplied from an ink bag to a recording head by a tube and color ink low in printing frequency is supplied from a recording unit detachably mounted on a carriage to the recording head. The recording apparatus can perform recording operation irrespective of presence/absence of a color printing recording unit, and can change control of a carriage driving motor based on presence/absence of an ink cartridge.

In the configuration discussed in Japanese Patent Application Laid-Open No. H9-76537, however, if the recording operation is continued in a state where the color printing recording unit is not mounted, ink mist may adhere to a contact unit that performs electric connection, provided on the carriage. Further, contact failure of the contact unit may occur due to adhesion of the ink mist.

The present invention is directed to an inkjet recording apparatus that can prevent contact failure between a carriage and an ink cartridge.

SUMMARY OF THE INVENTION

According to an aspect of the present invention, an inkjet recording apparatus configured to perform recording operation by ejecting ink at least from a first recording head, includes an ink tank configured to contain the ink to be supplied to the first recording head, a tube configured to connect the first recording head and the ink tank, and a carriage including a first mounting portion on which the first recording head is mounted, a second mounting portion on which a second recording head is detachably mounted, and a contact portion electrically connected to the second recording head, and configured to reciprocate. A protection member protecting the contact portion can be detachably mounted on the second mounting portion.

Further features of the present invention will become apparent from the following description of exemplary embodiments with reference to the attached drawings.

DESCRIPTION OF THE EMBODIMENTS

Some exemplary embodiments of the present invention are described below with reference to drawings. The following exemplary embodiments do not limit the present invention, and all of combinations of features described in the exemplary embodiments are not necessarily essential for the present invention. Further, relative arrangement, shapes, etc. of components described in the exemplary embodiments are illustrative, and do not intend to limit the scope of the present invention to the described relative arrangement, shapes, etc.

Apparatus Configuration

Figure 1:
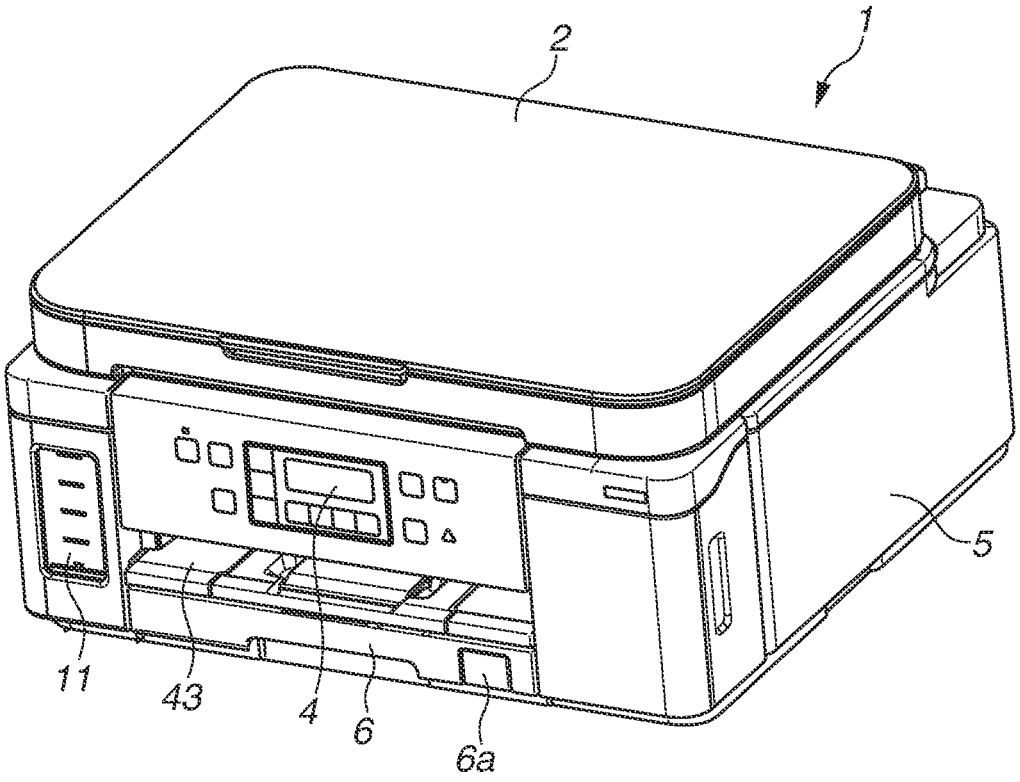
FIG. 1 is an external perspective view illustrating an inkjet recording apparatus according to a first exemplary embodiment.
Figure 2:
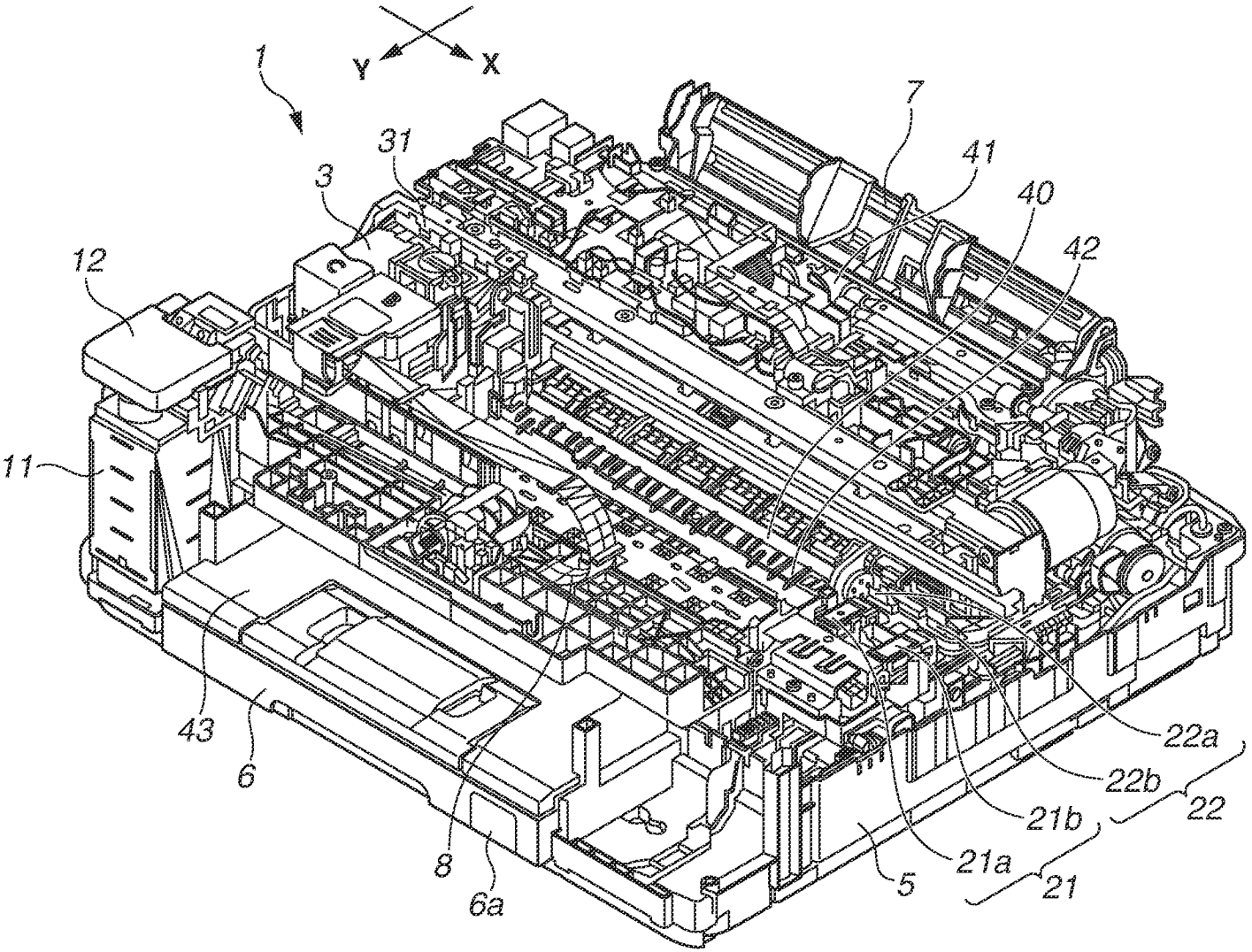
FIG. 2 is a perspective view illustrating an internal configuration of the inkjet recording apparatus according to the first exemplary embodiment.

FIG. 1 is an external perspective view illustrating an inkjet recording apparatus (hereinafter, recording apparatus) 1 according to a first exemplary embodiment. FIG. 2 is a perspective view illustrating an internal configuration of the recording apparatus 1. The recording apparatus 1 includes a housing 5, a recording unit 3 that performs recording operation on a recording medium, and a tank 11 that serves as an ink container containing ink to be supplied to the recording unit 3. In the present exemplary embodiment, the ink tank 11 is disposed on a front surface of the housing 5 and is fixed to an apparatus body. Further, an operation unit 4 that enables a user to perform operation such as instruction input to the recording apparatus 1 is also provided on the front surface of the housing 5. The operation unit 4 according to the present exemplary embodiment includes a display panel that can display error, etc. of the recording apparatus 1.

A sheet feeding cassette 6 that is insertable into and removable from the housing 5 by the user is provided on the front surface of the housing 5. The sheet feeding cassette 6 includes a window 6*a* that enables the user to visually recognize recording media stacked inside the sheet feeding cassette 6. The window 6*a* is desirably configured by a transparent member such as glass and plastic.

A scanner unit 2 that performs document reading operation is provided at an upper part of the housing 5 so as to be openable/closable to the housing 5. FIG. 2 illustrates the recording apparatus 1 from which the scanner unit 2 and a part of the housing 5 are removed. When the scanner unit 2 is opened, a tank cover 12 that can cover a top surface of the ink tank 11 is exposed. In FIG. 2, the tank cover 12 is closed. The detail of the tank cover 12 will be described below. Alternatively, a body cover not mounted with the scanner unit 2 may be openable/closeable to the housing 5.

The recording apparatus 1 feeds a recording medium stacked in the sheet feeding cassette 6 provided on the front surface of the housing 5 or in a sheet feeding tray 7 provided on a rear surface of the housing 5, by a feeding roller (feeding unit) 41. The recording medium fed by the feeding roller 41 is conveyed onto a platen 42 disposed at a position facing the recording unit 3, by a conveyance roller (conveyance unit) 40. The platen 42 is a member that guides and supports the recording medium recorded by the recording unit 3. The recording medium on which recording by the recording unit 3 has been completed is discharged by a discharge roller onto a sheet discharge tray (discharge unit) 43. The sheet discharge tray 43 is disposed above the sheet feeding cassette 6.

A direction (Y direction illustrated in FIG. 2) in which the recording medium is conveyed by the conveyance roller 40 is referred to as a conveyance direction. In other words, an upstream side in the conveyance direction corresponds to the rear surface side of the housing 5, and a downstream side in the conveyance direction corresponds to the front surface side of the housing 5.

The recording unit 3 is mounted on a carriage 31 that reciprocates in a main scanning direction (X direction illustrated in FIG. 2) intersecting with the conveyance direction, along a guide rail, etc. In the present exemplary embodiment, the conveyance direction and the main scanning direction are orthogonal to each other. The recording unit 3 ejects ink droplets while moving together with the carriage 31 in the main scanning direction, to record an image for one band to the recording medium (recording operation). After the image for the one band is recorded, the recording medium is conveyed by a predetermined amount by the conveyance roller 40 in the conveyance direction (intermittent conveyance operation). The image is recorded on the entire recording medium based on recording data by repeating the recording operation for one band and the intermittent conveyance operation.

The recording apparatus 1 includes a recovery unit inside a moving area of the carriage 31 and outside a recording area where the recording operation by the recording unit 3 is performed. The recovery unit performs recovery operation to maintain ejection performance of the recording unit 3, and is disposed at a position facing an ejection port surface on which ejection ports of ink are arranged. The recovery unit includes a cap 21 that seals the ejection port surface, and a wiper 22 that can wipe the ejection port surface. The detailed configuration of the recovery unit is described below.

The ink tank 11 is provided on a left side of the sheet feeding cassette 6 and the sheet discharge tray 43 when the recording apparatus 1 is viewed from the front side. The ink tank 11 according to the present exemplary embodiment contains black ink. The ink tank 11 is connected to the recording unit 3 by a flexible supply tube 8 that configures an ink supply path for supplying the ink to the recording unit 3. In the present exemplary embodiment, the ink tank 11 and the recovery unit are disposed separately from each other in the main scanning direction.

Ink Injection Operation

Figure 3A:
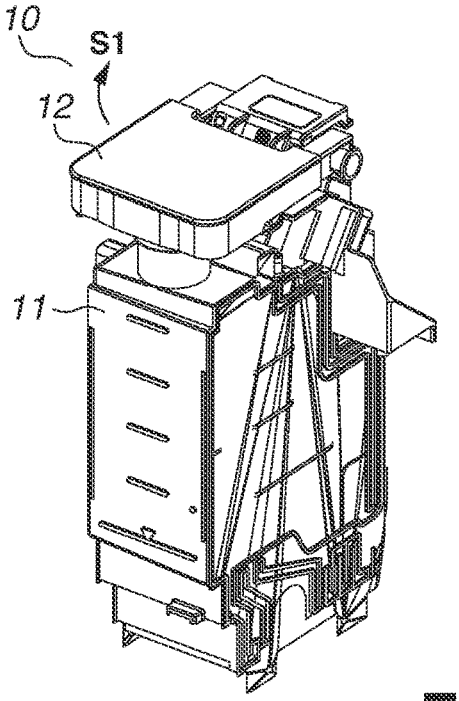
FIGS. 3A, 3B, 3C, and 3D are external perspective views each illustrating a tank unit according to the first exemplary embodiment.
Figure 3B:
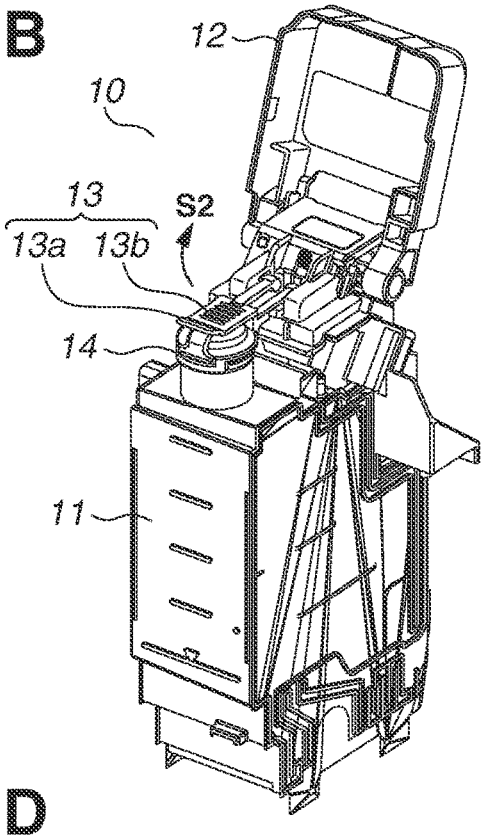
Figure 3C:
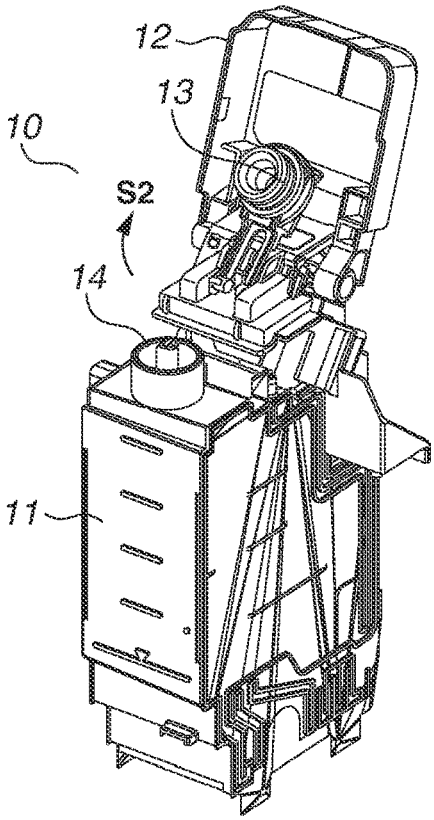

FIGS. 3A to 3D are external perspective views each illustrating a tank unit 10 that includes the ink tank 11 and a peripheral configuration thereof. FIG. 3A illustrates a state where the tank cover 12 is closed, and FIG. 3B illustrates a state where the tank cover 12 is open. The user can access a tank cap 13 by opening the tank cover 12 in a direction S1.

An injection portion 14 for injection of the ink is provided on an upper surface of the ink tank 11, and is sealable by the tank cap 13. The tank cap 13 includes a cap portion 13*a* to seal the injection portion 14, and a lever portion 13*b* that supports the cap portion 13*a* and is operable by the user. The lever portion 13*b* is turnably supported to a main body of the recording apparatus 1. The user can inject the ink by removing the cap portion 13*a* from the injection portion 14 while turning the lever portion 13*b* in a direction S2 illustrated in FIG. 3B (see FIG. 3C). The lever portion 13*b* may be turnably supported to the ink tank 11 or the tank cover 12.

Figure 3D:
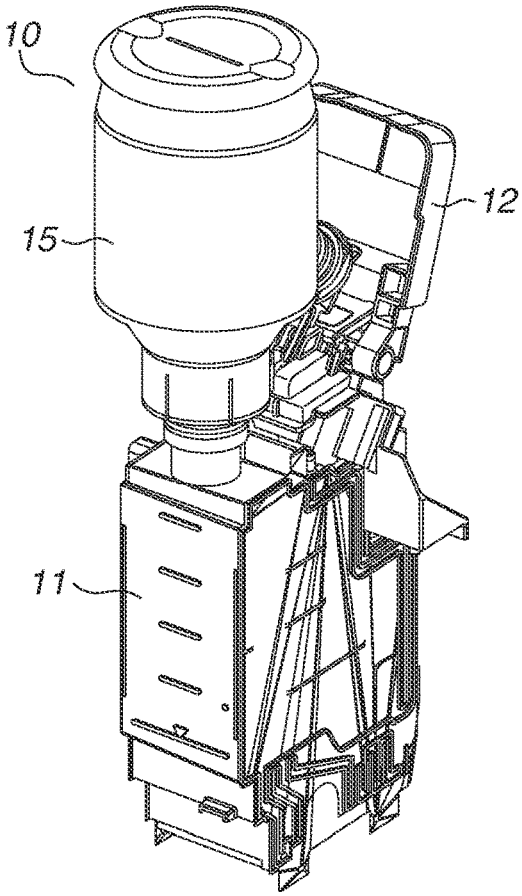

FIG. 3D illustrates a state where an ink bottle 15 serving as an ink replenishing container is inserted into the injection portion 14 and the ink is injected in a state where the tank cap 13 is removed. In the present exemplary embodiment, the ink of the ink bottle 15 is injected into the ink tank 11 through gas-liquid exchange with air inside the ink tank 11.

Ink Supply Configuration

Figure 4A:
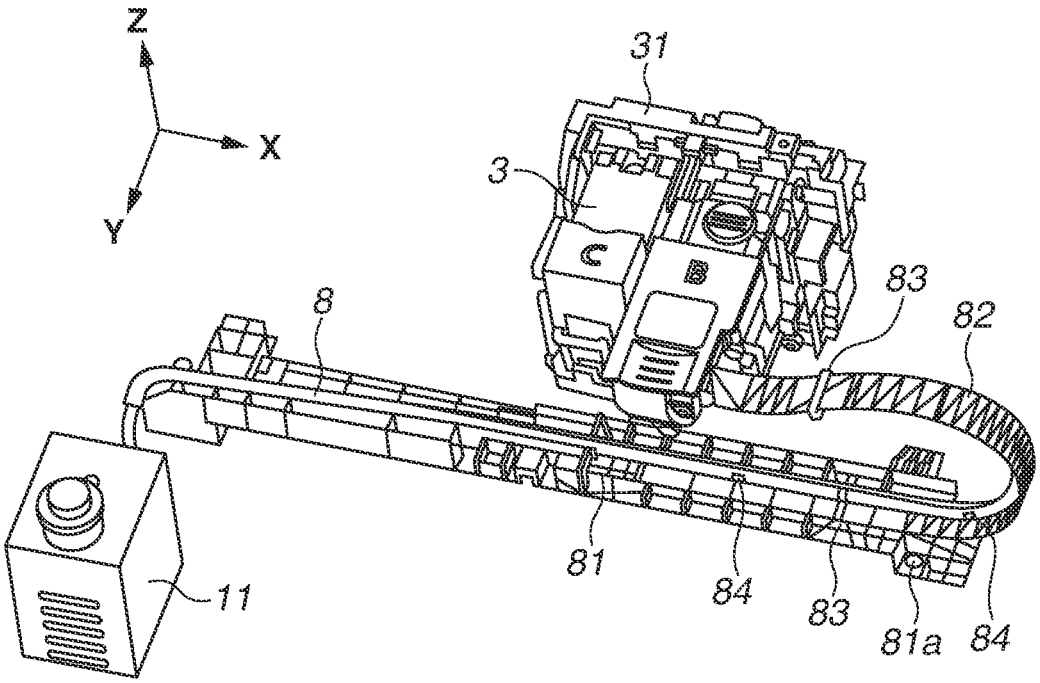
FIGS. 4A and 4B are respectively a schematic top perspective view and a front schematic view relating to ink supply of the inkjet recording apparatus according to the first exemplary embodiment.
Figure 4B:
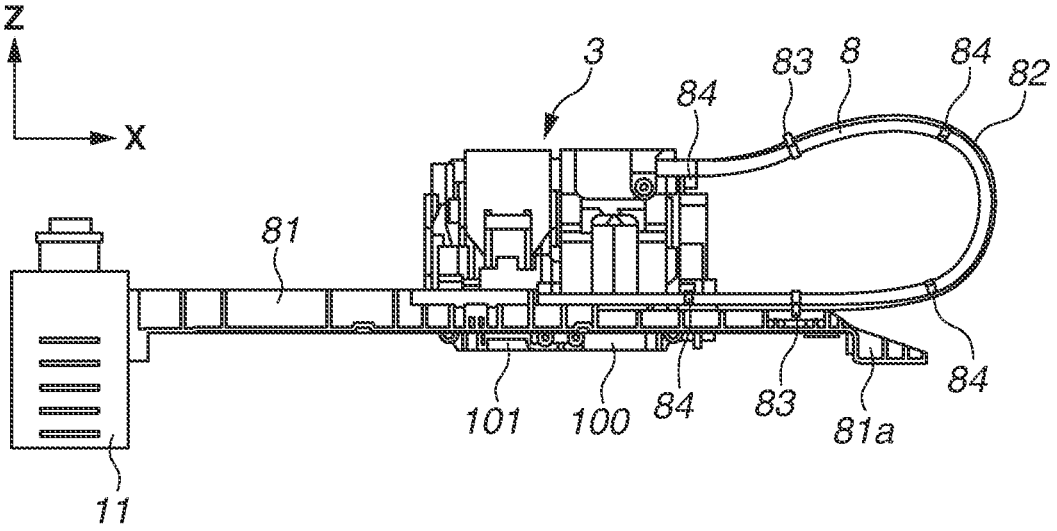

FIG. 4A is a schematic top perspective view of an ink supply unit, and FIG. 4B is a front schematic view of the ink supply unit. A tube guide plate 81, a tube guide sheet 82, a plurality of tube holder sliders 83, and a plurality of tube holders 84 are attached to the supply tube 8. The supply tube 8 is laid from the left side on which the ink tank 11 is provided to the right side in the X direction on which the recovery unit is provided, is then laid so as to bend upward in a vertical direction (Z direction), and is connected to the recording unit 3. The supply tube 8 extends over the recording area by the recording unit 3 in the X direction. Further, the supply tube 8 includes a portion that moves with movement of the recording unit 3, and a portion that does not move with the movement of the recording unit 3.

The tube guide plate 81 fixes the portion of the supply tube 8 that does not move with the movement of the recording unit 3, and supports and guides the portion of the supply tube 8 that moves with the movement of the recording unit 3. The tube guide plate 81 fixes the supply tube 8 to a lower part of the recording apparatus 1, thereby preventing the user from easily touching the supply tube 8. This prevents the user from pulling the supply tube 8 and causing the supply tube to be disconnected from the recording unit 3 which would then prevent the ink inside the supply tube 8 from scattering.

At a portion of the supply tube 8 that may abut on the housing 5 and the tube guide plate 81 when the portion of the supply tube 8 moves with the movement of the carriage 31, the tube guide sheet 82 is provided to reduce abrasion of the supply tube 8. One end of the tube guide sheet 82 is fixed to the tube guide plate 81, and the other end is fixed to the recording unit 3. The tube guide sheet 82 also can move together with the supply tube 8 along with reciprocation of the recording unit 3.

Figure 5A:
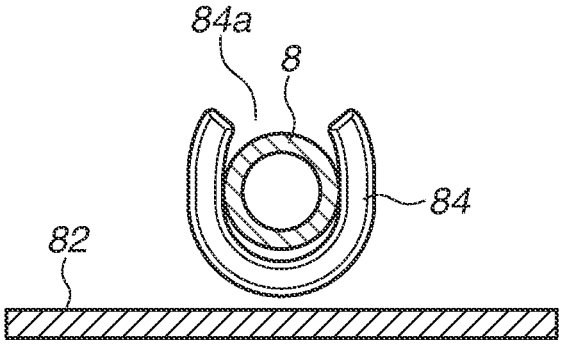
FIGS. 5A 5B, and 5C are enlarged cross-sectional views each illustrating a detail of a tube holder according to the first exemplary embodiment.
Figure 5B:
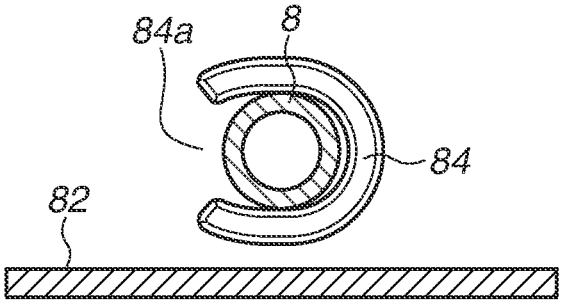
Figure 5C:
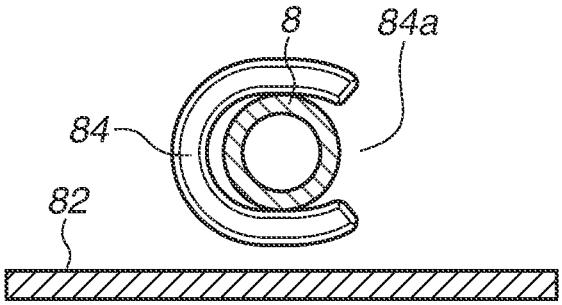

Further, the supply tube 8 is held by the tube holders 84 at a plurality of positions. FIGS. 5A to 5C are enlarged cross-sectional views each illustrating a detail of one tube holder 84. As illustrated in FIG. 5A, each of the tube holders 84 holds the supply tube 8 so as to pinch the supply tube 8 from a lower side, and includes an opening 84*a* at an upper part. The tube holders 84 prevent abutting of the supply tube 8 and the tube guide sheet 82 to reduce abrasion of the supply tube 8. A direction of the opening 84*a* is not limited to the upper part, and the opening 84*a* may be directed in lateral directions as illustrated in FIG. 5B and FIG. 5C.

Figure 6:
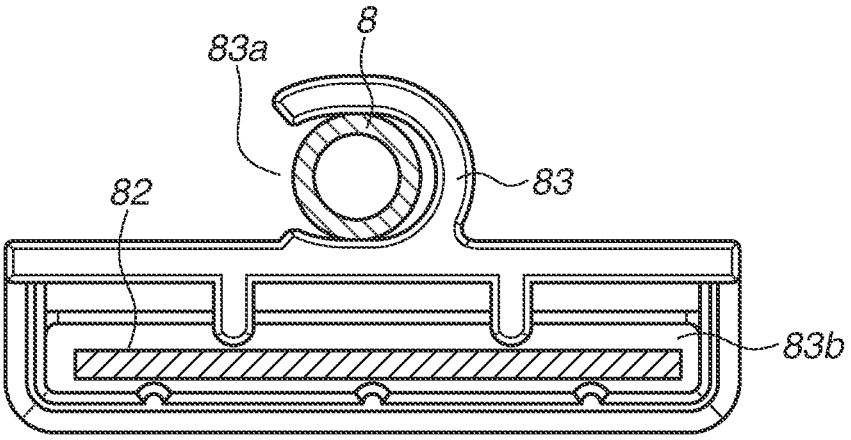
FIG. 6 is an enlarged cross-sectional view illustrating a detail of a tube slider according to the first exemplary embodiment.

FIG. 6 is an enlarged cross-sectional view illustrating a detail of one tube holder slider 83. The tube holder sliders 83 each include a fixing part 83*a* for fixing the supply tube 8 and an opening 83*b* into which the tube guide sheet 82 is insertable, and are provided at a plurality of positions. The supply tube 8 is held by the fixing part 83*a* and the tube guide sheet 82 is inserted into the opening 83*b*, which prevents the supply tube 8 and the tube guide sheet 82 from separating due to the reciprocation of the recording unit 3. The fixing part 83*a* opens in a lateral direction as illustrated in FIG. 6. This makes it possible to restrict motion of the supply tube 8 in a direction separating from the tube guide sheet 82 (upward direction in FIG. 6). Even when the fixing part 83*a* of the tube holder slider 83 opens on a right side in FIG. 6, similar effects are achievable.

Subsequently, the detailed configuration of the recording unit 3 will be described with reference to FIG. 7A to FIG. 7C. The recording unit 3 includes a black recording head (a black head cartridge) 100 that can eject black ink, and a color recording head (a color head cartridge) 101 that can eject color ink. The black recording head 100 is mounted on a first mounting portion 31*b* of the carriage 31, and the color recording head 101 is mounted on a second mounting portion 31*c* of the carriage 31. The carriage 31 includes a turnable first headset cover 32 and a turnable second headset cover 33. The first headset cover 32 covers the black recording head 100 to fix the black recording head 100 to the carriage 31. The second headset cover 33 covers the color recording head 101 to fix the color recording head 101 to the carriage 31.

Figure 7A:
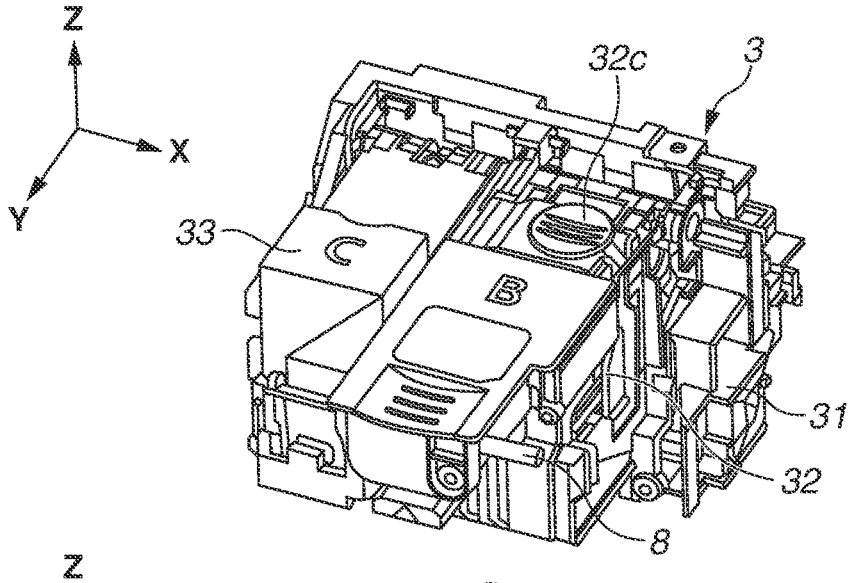
FIGS. 7A, 7B, and 7C are top perspective views each illustrating a recording unit according to the first exemplary embodiment.
Figure 7B:
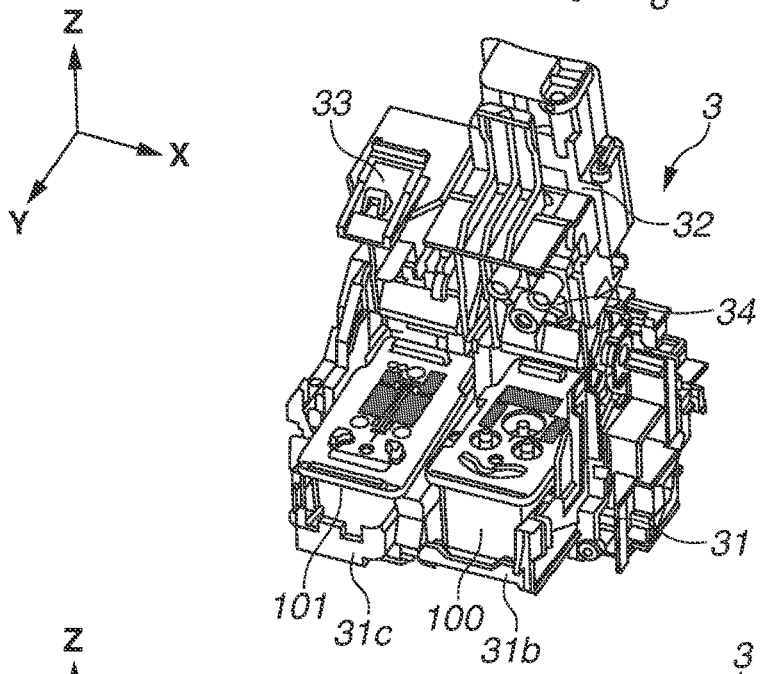

FIG. 7A illustrates a state where the first headset cover 32 and the second headset cover 33 are located at respective covering positions, and FIG. 7B illustrates a state where the first headset cover 32 and the second headset cover 33 are located at respective exposure positions where the respective heads are exposed.

Figure 7C:
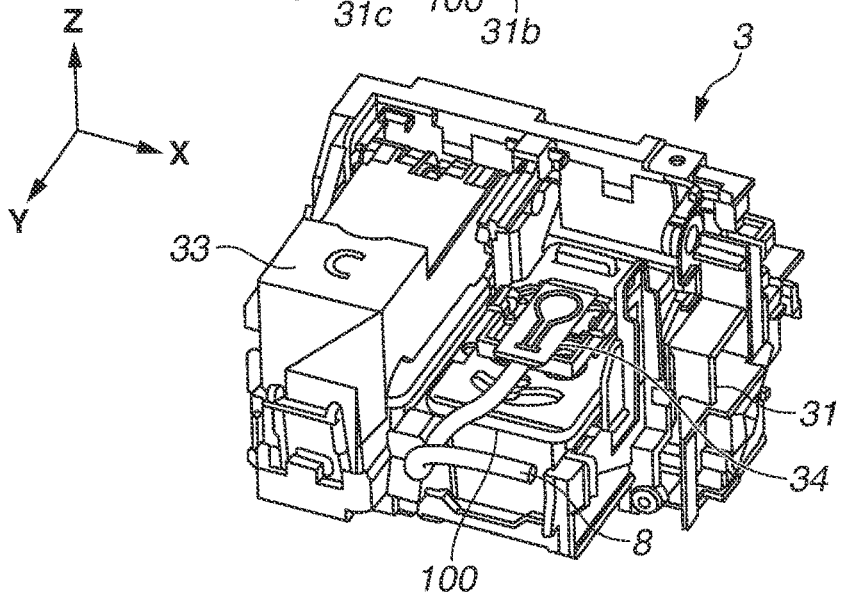

FIG. 7C is a top perspective view illustrating the recording unit 3 from which the first headset cover 32 is removed. The black recording head 100 is connected to the supply tube 8 through a joint 34, and the black ink contained in the ink tank 11 is supplied by the supply tube 8. The joint 34 is integrated with the first headset cover 32, and joint connection is realized through operation of the first headset cover 32 by the user.

More specifically, when the user turns the first headset cover 32 from the exposure position to the covering position, the black recording head 100 is positioned to the carriage 31. Further, when the user presses a pressing part 32*c* of the first headset cover 32, the joint connection of the black recording head 100 and the supply tube 8 by the joint 34 is completed. As a result, the ink can be supplied from the ink tank 11 to the black recording head 100. Note that the black recording head 100 may be provided integrally with an ink tank that can contain the ink supplied from the supply tube 8.

On the other hand, the color recording head 101 is an ink cartridge in which the recording head and the ink tank are integrated, and is optionally detachable from the carriage 31 in the recording apparatus 1.

Figure 8A:
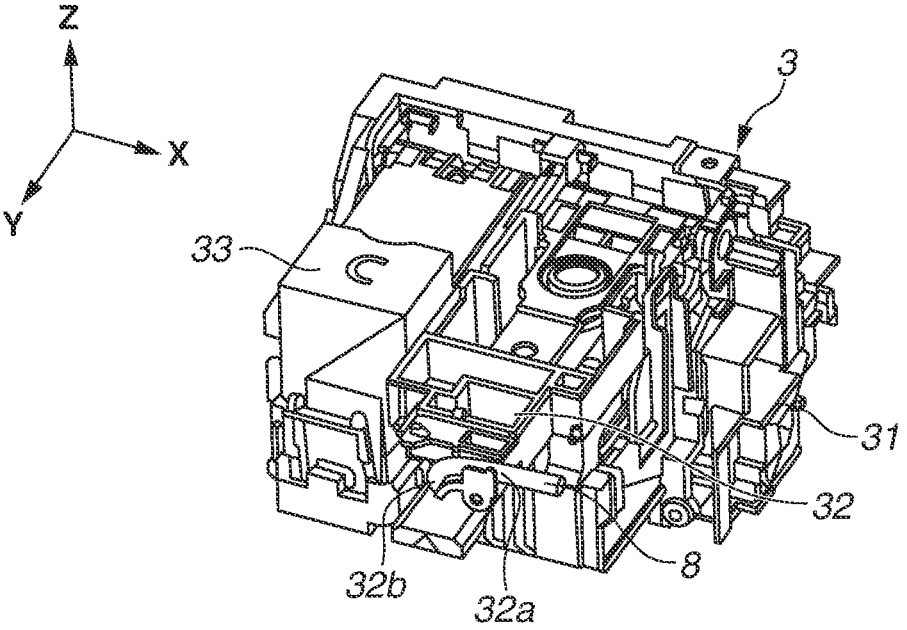
FIGS. 8A and 8B are top perspective views illustrating a detail of the recording unit and a detail of a supply tube according to the first exemplary embodiment.
Figure 8B:
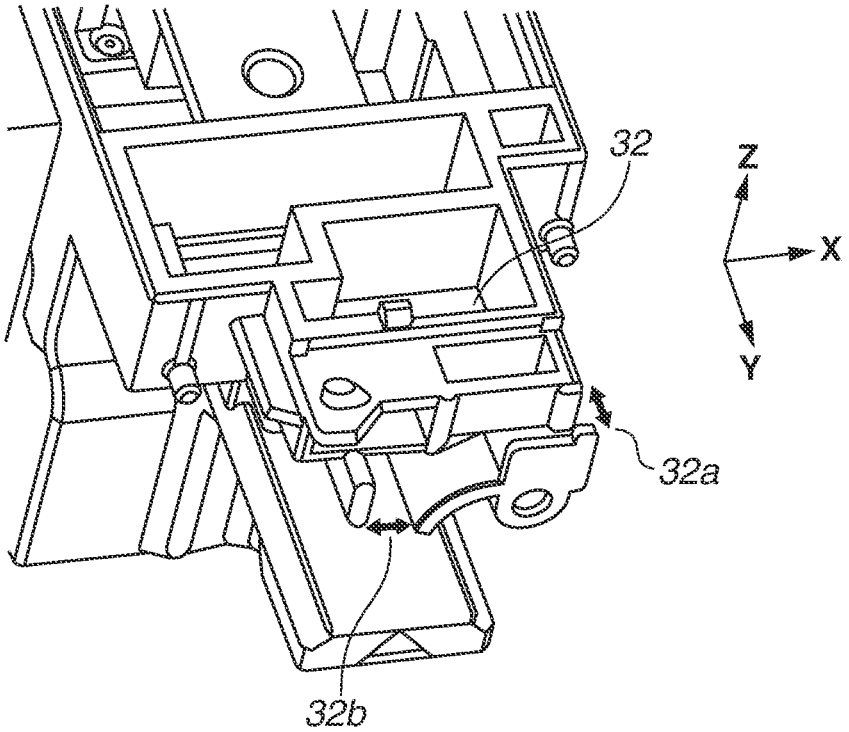

FIGS. 8A and 8B illustrate the detailed configuration of the recording unit 3 and the supply tube 8. FIG. 8A is a top perspective view in which illustration of a top surface of the first headset cover 32 is omitted, and FIG. 8B is a top enlarged view of the first headset cover 32. The supply tube 8 is held by a first fixing part 32*a* and a second fixing part 32*b* provided on the first headset cover 32, and is fixed to the recording unit 3.

The first fixing part 32*a* holds the supply tube 8 disposed along the X direction by the tube guide sheet 82, etc. illustrated in FIGS. 4A and 4B, and fixes the supply tube 8 in the Y direction. The second fixing part 32*b* holds the supply tube 8 fixed by the first fixing part 32*a* while the extending direction of the supply tube 8 is changed from the X direction to the Y direction, and fixes the supply tube 8 in the X direction. As illustrated in FIG. 7C, the supply tube 8 fixed by the second fixing part 32*b* is connected to the joint 34 along the Y direction.

When the first fixing part 32*a* and the second fixing part 32*b* hold and fix the supply tube 8 in the two different directions, force is hardly applied in the Y direction in which the supply tube 8 is connected to the joint 34 even when the user pulls the supply tube 8 in the X direction. This makes it possible to prevent the supply tube 8 from being disconnected from the joint 34. As described above, the supply tube 8 is connected to the joint 34 after the supply tube 8 is fixed in the direction different from the connection direction with the joint 34, which prevents the supply tube 8 from being disconnected from the joint 34.

Figure 9A:
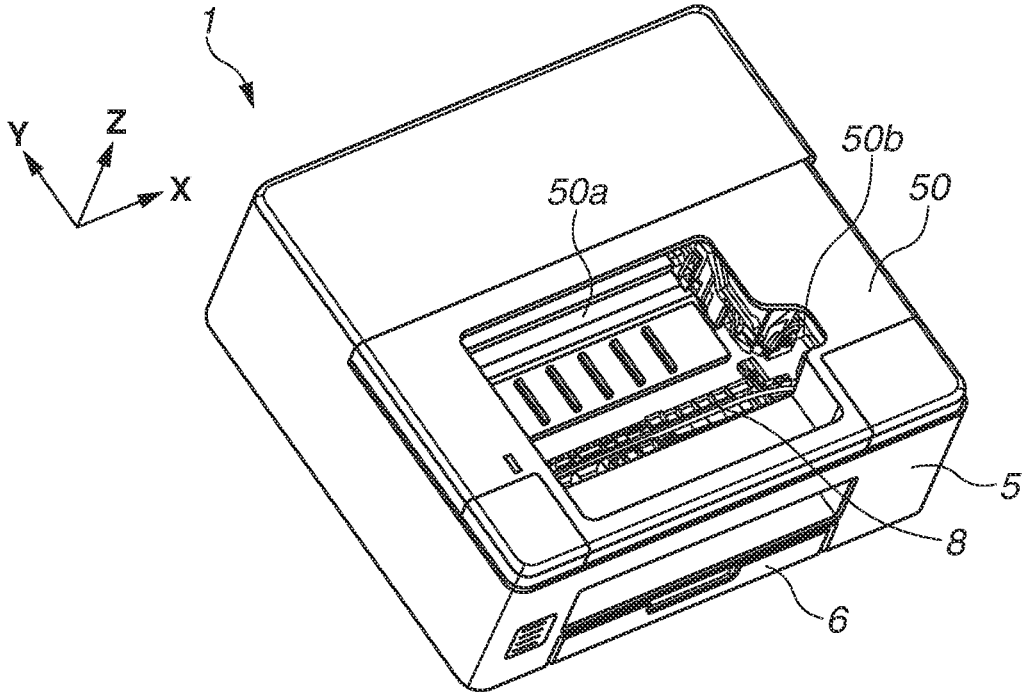
FIGS. 9A and 9B are diagrams each illustrating the recording unit that is located at a home position of the inkjet recording apparatus according to the first exemplary embodiment.
Figure 9B:
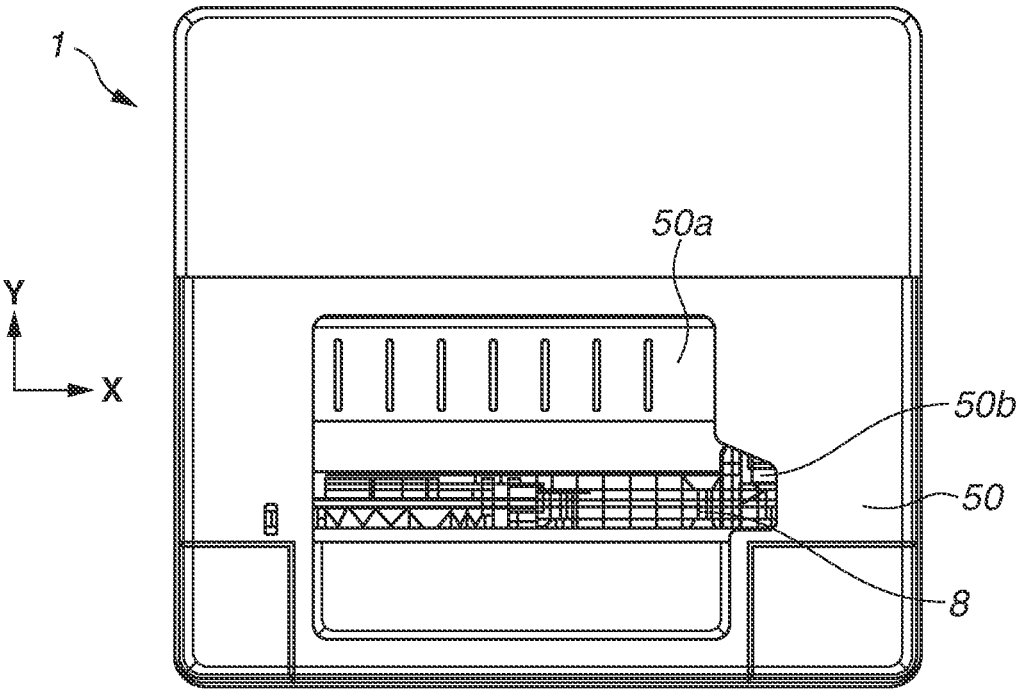

FIG. 9A is an external perspective view of the recording apparatus 1 in a state where the scanner unit 2 is open, and FIG. 9B is a top view thereof. In FIGS. 9A and 9B, illustration of the scanner unit 2 is omitted. When the scanner unit 2 is opened, a frame 50 attached to the housing 5 is exposed. The frame 50 includes an opening 50*a* that is largely open to enable the user to perform operation such as attachment/detachment of the recording head, and a notch 50*b* that is a part of the opening 50*a*.

FIGS. 9A and 9B illustrate a state where the recording unit 3 is located at a recovery position (home position) facing the cap 21 illustrated in FIG. 2. When the recording unit 3 is located at the home position, the most part of the recording unit 3 is covered with the frame 50, and the user cannot easily touch the recording unit 3. As described above, the frame 50 protects the internal unit so as to prevent the user from touching the recording unit 3 and the carriage 31 through a part other than the opening 50*a* and the notch 50*b*.

Further, as described with reference to FIGS. 4A and 4B, the supply tube 8 is bent from the lower side to the upper side on the right side (i.e., side provided with recovery unit in X direction) as viewed from the front side of the recording apparatus 1. Thus, when the recording unit 3 is located at the home position facing the cap 21 (recovery unit), a bent part

8*a* of the supply tube 8 is also covered with the frame 50. This makes it possible to prevent the user from pulling the supply tube 8, etc. The supply tube 8 exposed from the opening 50*a* irrespective of the position of the recording unit 3 is fixed to the lower part of the recording apparatus 1.

Figure 10:
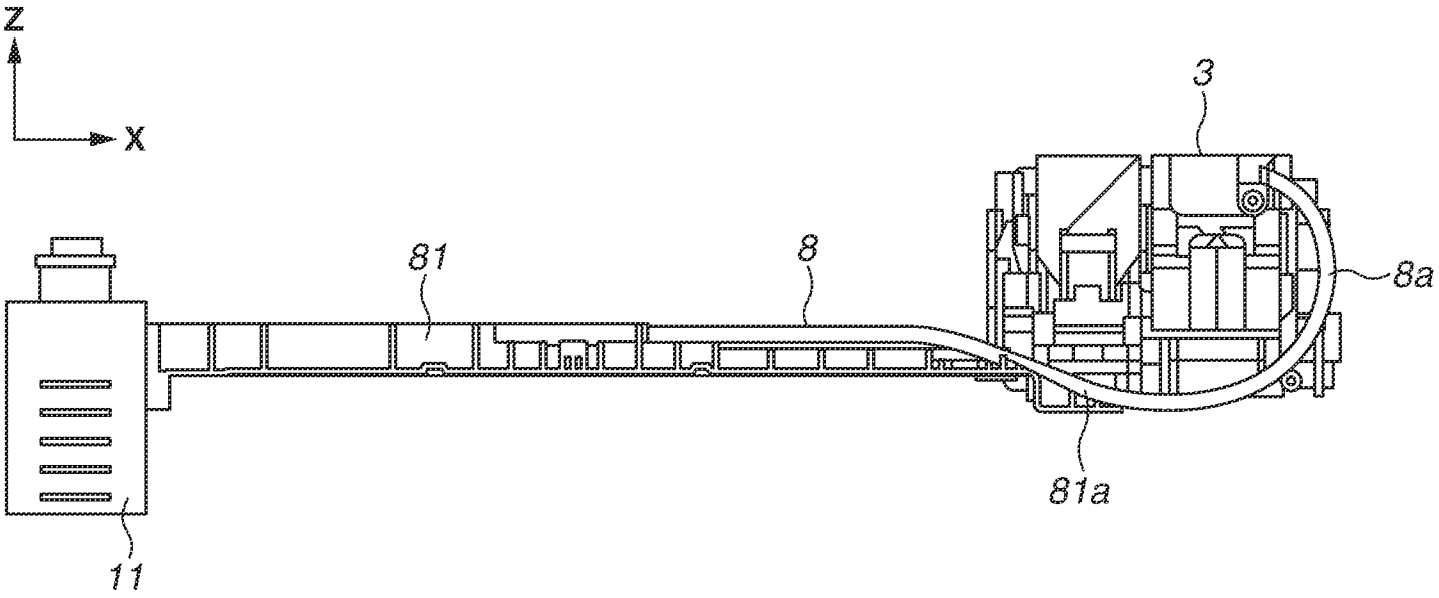
FIG. 10 is a front view when the recording unit is located at the home position according to the first exemplary embodiment.

FIG. 10 is a front view when the recording unit 3 is located at the home position. The tube guide plate 81 includes an inclined part 81*a* that is inclined downward toward the recovery unit. The supply tube 8 is guided and supported downward by the inclined part 81*a*. As a result, even in the configuration in which the recovery unit is provided near the side surface of the housing 5 and the bent part 8*a* of the supply tube 8 is provided at a position near the recovery unit in the X direction, a curvature radius of the bent part 8*a* can be made large. In other words, as compared with a case where the inclined part 81*a* is not provided and the tube guide plate 81 is flat, bending of the supply tube 8 can be moderated, and deformation of the supply tube 8 can be suppressed.

Typically, when the recording unit 3 is not performing the recording operation, the recording unit 3 stands by at the home position. Accordingly, even in a case where the recording unit 3 stands by at the home position for a long time, providing the inclined part 81*a* on the tube guide plate 81 makes it possible to suppress creep deformation of the supply tube 8.

Recording Head Replacement

Figure 11A:
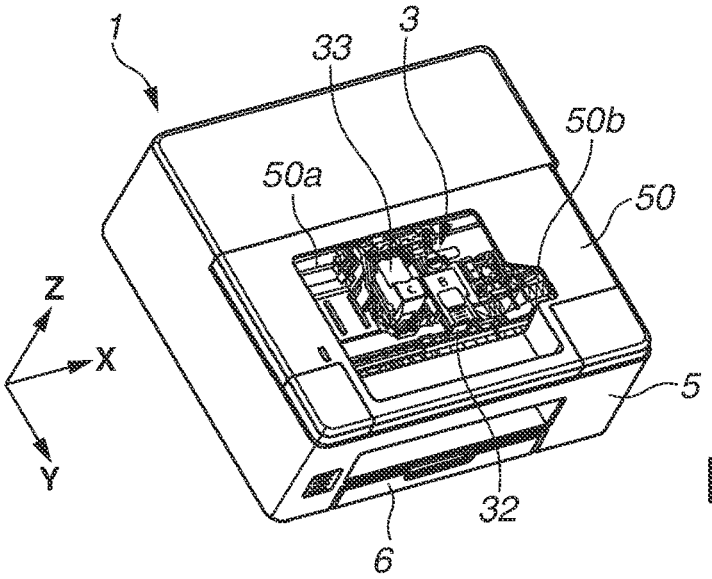
FIGS. 11A, 11B, and 11C are diagrams each illustrating a configuration relating to replacement of a black recording head according to the first exemplary embodiment.
Figure 11B:
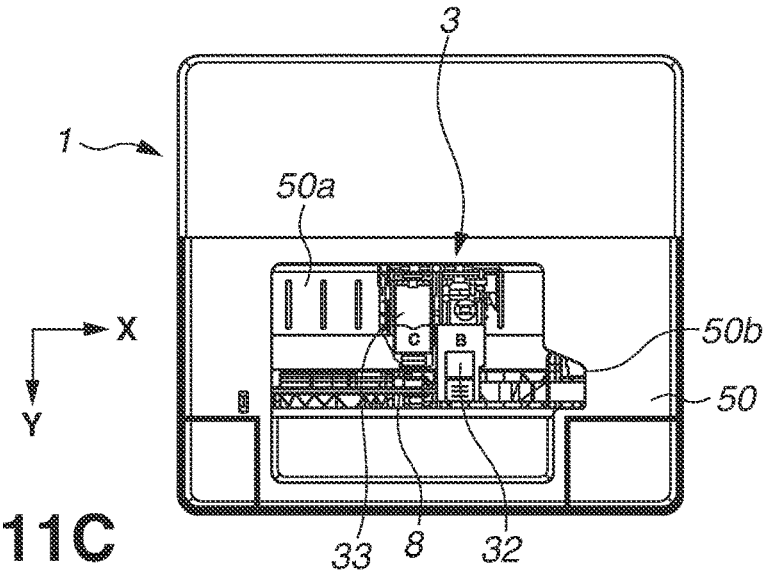
Figure 11C:
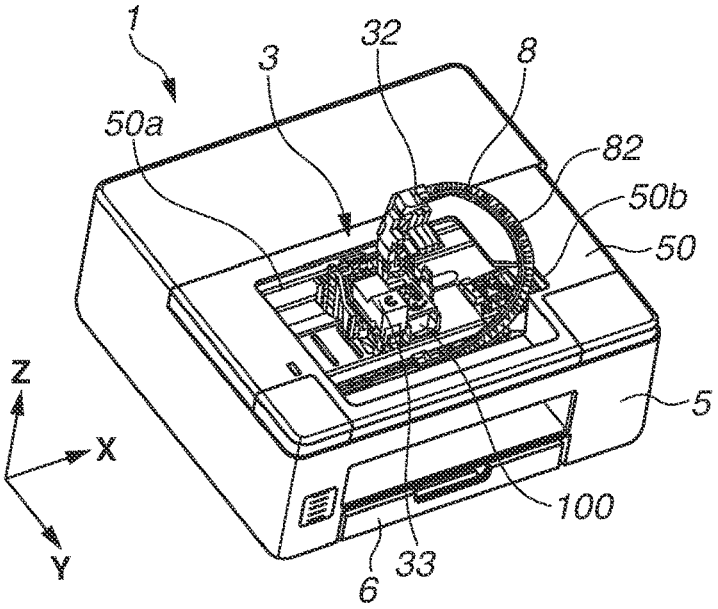

A configuration relating to replacement of the black recording head 100 will be described with reference to FIGS. 11A to 11C. FIG. 11A is an external perspective view illustrating a replacement position of the recording unit 3 when the black recording head 100 is replaced, and FIG. 11B is a top view thereof. The position of the recording unit 3 in the recording apparatus 1 at this time is referred to as a first replacement position.

At the first replacement position, both of the first headset cover 32 and the second headset cover 33 are exposed from the opening 50*a* of the frame 50. Therefore, both of the first headset cover 32 and the second headset cover 33 are operable by the user. When the user turns the first headset cover 32 to the open state while the recording unit 3 is located at the first replacement position, the supply tube 8 connected to the first headset cover 32 also moves. At this time, since the notch 50*b* is provided in the frame 50, the supply tube 8 moving with the first headset cover 32 and the frame 50 do not abut on each other as illustrated in FIG. 11C. This enables the user to smoothly replace the black recording head 100.

Figure 12A:
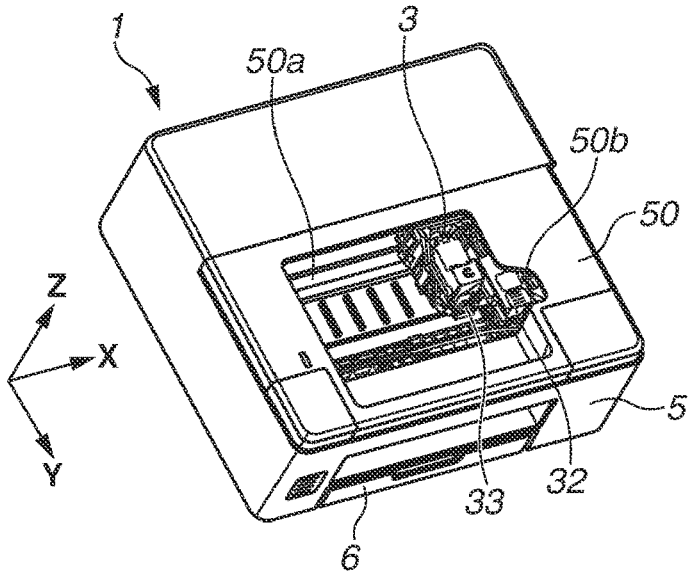
FIGS. 12A, 12B, and 12C are diagrams each illustrating a configuration relating to replacement of a color recording head according to the first exemplary embodiment.
Figure 12B:
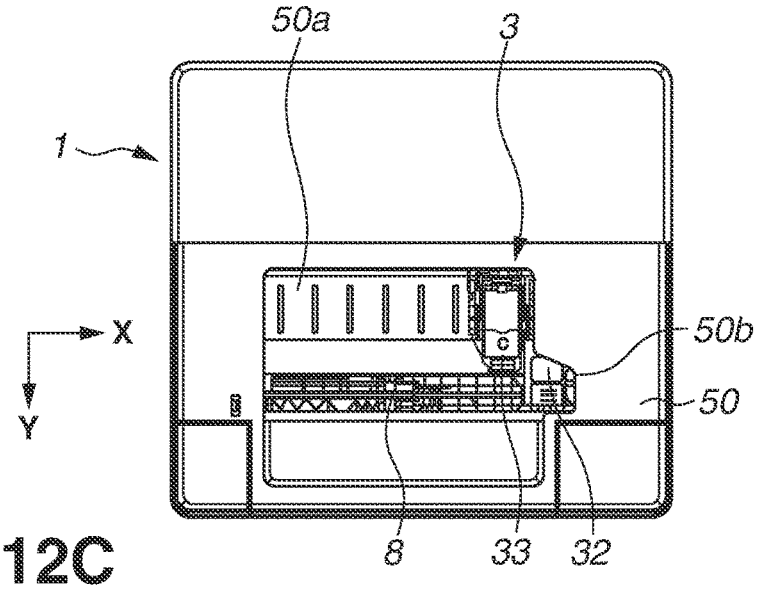
Figure 12C:
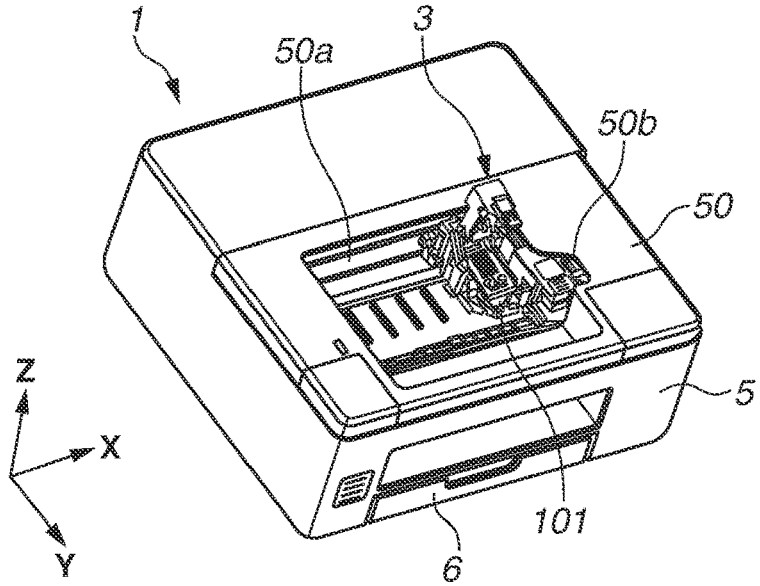

A configuration relating to replacement of the color recording head 101 will be described with reference to FIGS. 12A to 12C. FIG. 12A is an external perspective view illustrating a replacement position of the recording unit 3 when the color recording head 101 is replaced, and FIG. 12B is a top view thereof. The position of the recording unit 3 in the recording apparatus 1 at this time is referred to as a second replacement position.

The second replacement position of the recording unit 3 is a position closer to the recovery unit than the first replacement position in the X direction. At the second replacement position, the entire second headset cover 33 for replacing the color recording head 101 is exposed from the opening 50*a* of the frame 50, and the second headset cover 33 is operable by the user. In contrast, the first headset cover 32 for replacing the black recording head 100 is partially covered with the opening 50*a* and the notch 50*b*. Therefore, the first headset cover 32 is not operable by the user.

As described above, at the second replacement position, the first headset cover 32 is covered with the frame 50 so as to prevent replacement of the black recording head 100. This makes it possible to prevent the first headset cover 32 from being erroneously operated by the user. Further, when the recording unit 3 is located at the second replacement position, the connection portion of the supply tube 8 and the first headset cover 32 is also covered with the frame 50. This makes it possible to prevent the user from accessing the supply tube 8.

As described in the present exemplary embodiment, the first recording head to which the ink is supplied from the ink tank 11 by the supply tube 8 is disposed on the side close to the recovery unit in the recording unit 3. In contrast, the second recording head that is integrated with the ink tank and is higher in replacement frequency than the first recording head is disposed on the side far from the recovery unit in the recording unit 3. Further, the supply tube 8 includes the bent part 8*a* that bends upward on the side provided with the recovery unit in the X direction, and is connected to the recording unit 3 (first headset cover) above the tube guide plate 81. Moreover, the tube guide plate 81 guiding the supply tube 8 includes the inclined part 81*a* that is inclined downward toward the side provided with the recovery unit in the X direction.

The above-described configuration makes it possible to suppress deformation of the supply tube 8 while preventing the user from carelessly touching the supply tube 8.

Contact Protector

Figure 13:
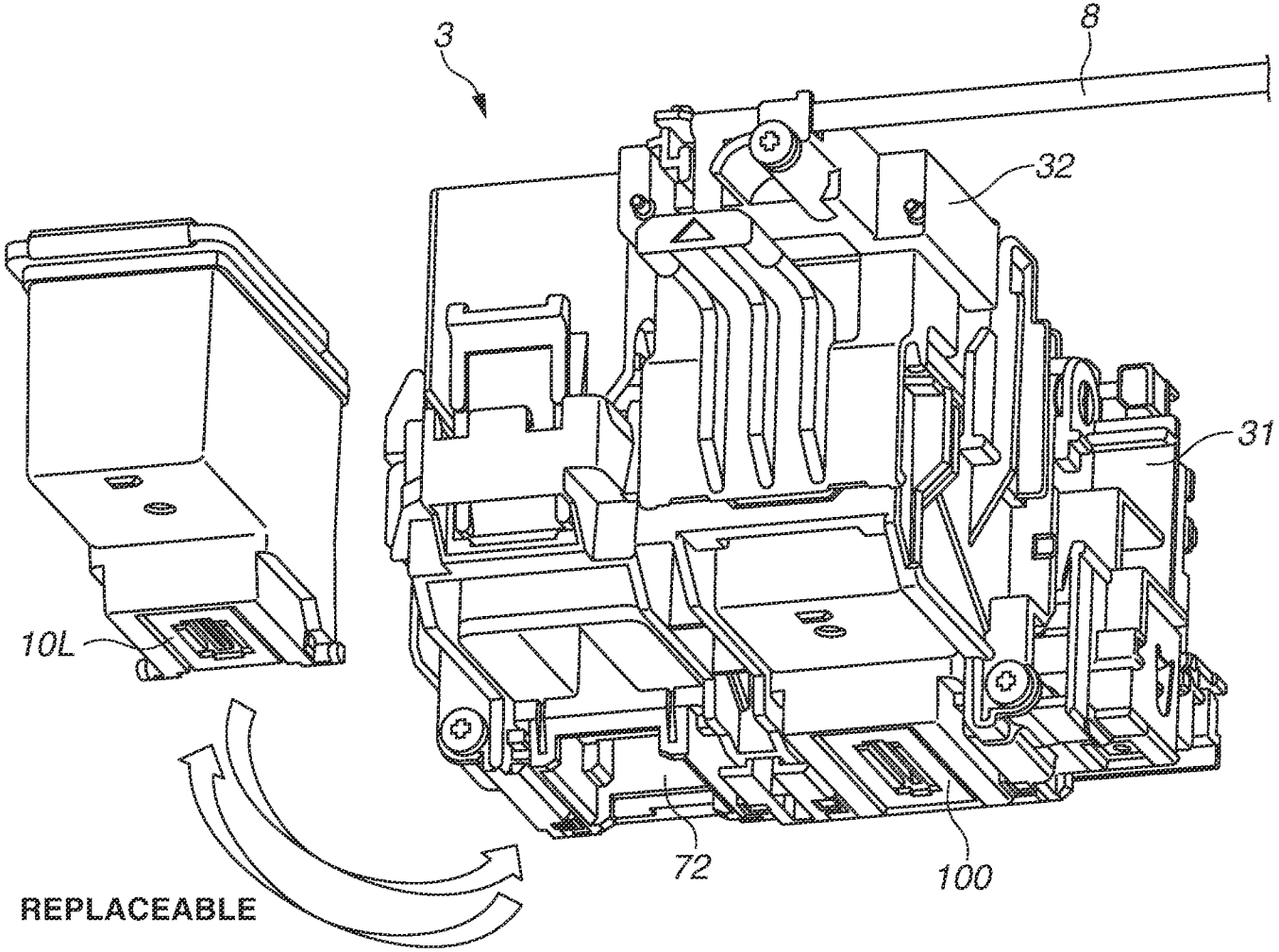
FIG. 13 is a diagram illustrating the recording unit according to the first exemplary embodiment.

The recording apparatus 1 in the state where the color recording head 101 is mounted has been described above. As illustrated in FIG. 13, the carriage 31 according to the present exemplary embodiment can be mounted with a contact protector 72 as a protection member, in place of the color recording head 101. In other words, the contact protector 72 can be mounted to the second mounting portion 31*c* mounted with the color recording head 101. In FIG. 13, the carriage 31 is mounted with the black recording head 100 and the contact protector 72. The recording apparatus 1 is normally usable as a monochrome printer that performs recording only with the black ink; however, when the user mounts the color recording head 101 in replace of the contact protector 72, the recording apparatus 1 can perform color printing. The detail thereof will be described below.

Figure 14:
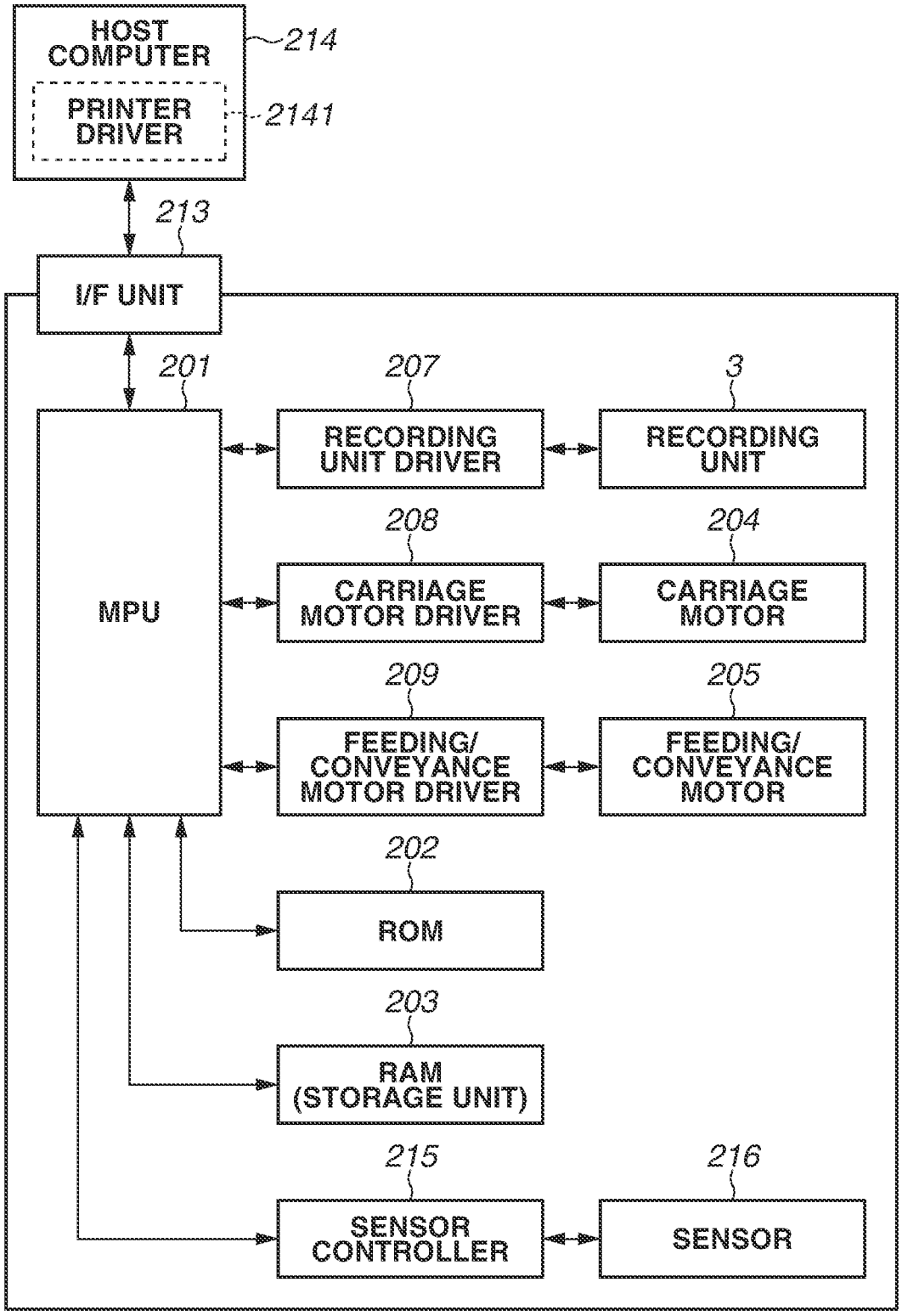
FIG. 14 is a block diagram of the inkjet recording apparatus according to the first exemplary embodiment.

FIG. 14 is a block diagram of the recording apparatus 1. A microprocessor unit (MPU) 201 as a control unit controls operation of each unit, data processing, etc. A read-only memory (ROM) 202 stores programs to be executed by the MPU 201 and data. A random access memory (RAM) 203 as a storage unit temporarily stores data of the processing executed by the MPU 201 and data received from a host computer 214. The recording unit 3 is controlled by a recording unit driver 207.

A carriage motor 204 that drives the carriage 31 is controlled by a carriage motor driver 208. The feeding roller 41 and the conveyance roller 40 are driven by a feeding/conveyance motor 205. The feeding/conveyance motor 205 is controlled by a feeding/conveyance motor driver 209. The discharge roller (not illustrated) is driven by the feeding/conveyance motor 205 in synchronization with the conveyance roller 40.

The host computer 214 includes a printer driver 2141 that collects recorded images and recorded information such as recorded image quality and communicates with the recording apparatus 1 when execution of the recording operation is instructed by the user. The MPU 201 exchanges the recorded images, etc. with the host computer 214 via an interface (I/F) unit 213. A sensor controller 215 is a controller that controls operation of various kinds of sensors 216. For example, the sensors 216 are detection units that can detect electric connection between the carriage 31 and the recording head.

Subsequently, referring back to FIG. 2, the detailed configuration of the recovery unit in the recording apparatus 1 will be described. The cap 21 of the recovery unit includes a color cap 21*a* that seals the ejection port surface of the color recording head 101, and a black cap 21*b* that seals the ejection port surface of the black recording head 100. The cap 21 is movable to a capping position that seals (caps) the ejection port surface and to a separated position separated from the ejection port surface. When the recording unit 3 does not perform the recording operation, the cap 21 seals the ejection port surface, thereby protecting the ejection port and preventing evaporation of the ink inside the ejection port.

The wiper 22 that is provided adjacent to the cap 21 includes a color wiper 22*a* that wipes the ejection port surface of the color recording head 101, and a black wiper 22*b* that wipes the ejection port surface of the black recording head 100. The wiper 22 performs wiping operation to wipe the ink adhered to the ejection port surface of the recording head by moving along the Y direction while abutting on the ejection port surface of the recording head. Further, the color wiper 22*a* and the black wiper 22*b* integrally move in the Y direction by the same driving source.

Figure 15A:
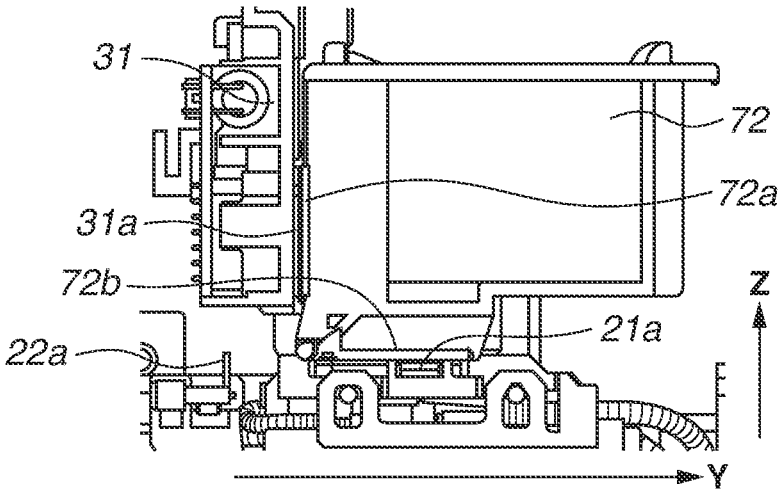
FIGS. 15A, 15B and 15C are diagrams illustrating a detail of a contact protector according to the first exemplary embodiment.
Figure 15B:
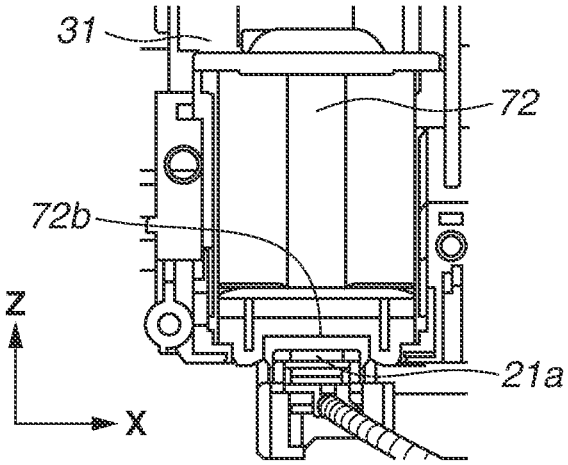
Figure 15C:
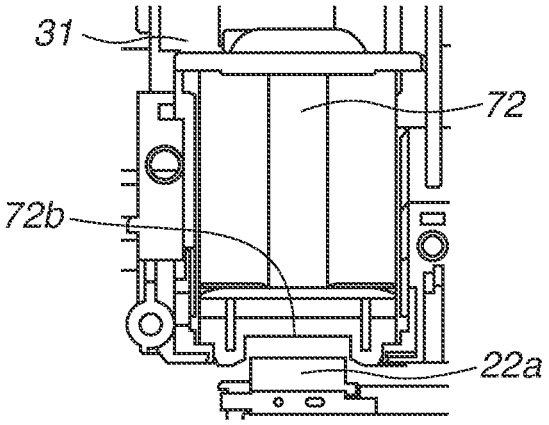

FIGS. 15A to 15C illustrate the detailed configuration of the contact protector 72. FIG. 15A is a side view of a state where the recording unit 3 is located at the home position and the cap 21 is located at the capping position.

The contact protector 72 includes a substrate 72*a* that can abut on a connector (contact portion) 31*a* of the carriage 31. When the contact protector 72 is mounted on the carriage 31, the connector 31*a* and the substrate 72*a* abut on each other to establish electric connection, and the connector 31*a* is shielded by the substrate 72*a*. As a result, even when the ink mist is scattered due to the recording operation by the black recording head 100, it is possible to prevent the ink from adhering to the connector 31*a* to cause connection failure.

The contact protector 72 further includes a cap shielding part 72*b* that can shield the color cap 21*a*. FIG. 15B is a front view corresponding to FIG. 15A, and illustration of the color wiper 22*a* is omitted. As illustrated in FIG. 15B, the cap shielding part 72*b* can prevent a foreign matter from adhering to the color cap 21*a* by shielding the color cap 21*a* at the capping position in the X direction. In other words, the cap shielding part 72*b* includes a protrusion that protrudes downward so as to overlap with the color cap 21*a* at the capping position in the Z direction. As a result, even in a case where the recording unit 3 stands by for a long time, the color cap 21*a* is not left in the exposed state. This makes it possible to prevent a foreign matter from adhering to the color cap 21*a*.

FIG. 15C is a front view corresponding to FIG. 15A, and illustration of the color cap 21*a* is omitted. The cap shielding part 72*b* has a downward recessed shape retracted from a moving locus when the color wiper 22*a* performs the wiping operation in the Y direction. Accordingly, when the wiping operation for the black recording head 100 is performed, it is possible to prevent the color wiper 22*a* that integrally moves with the black wiper 22*b* in the Y direction, from coming into contact with the contact protector 72. As a result, abrasion of the color wiper 22*a* is also reduced.

Figure 16:
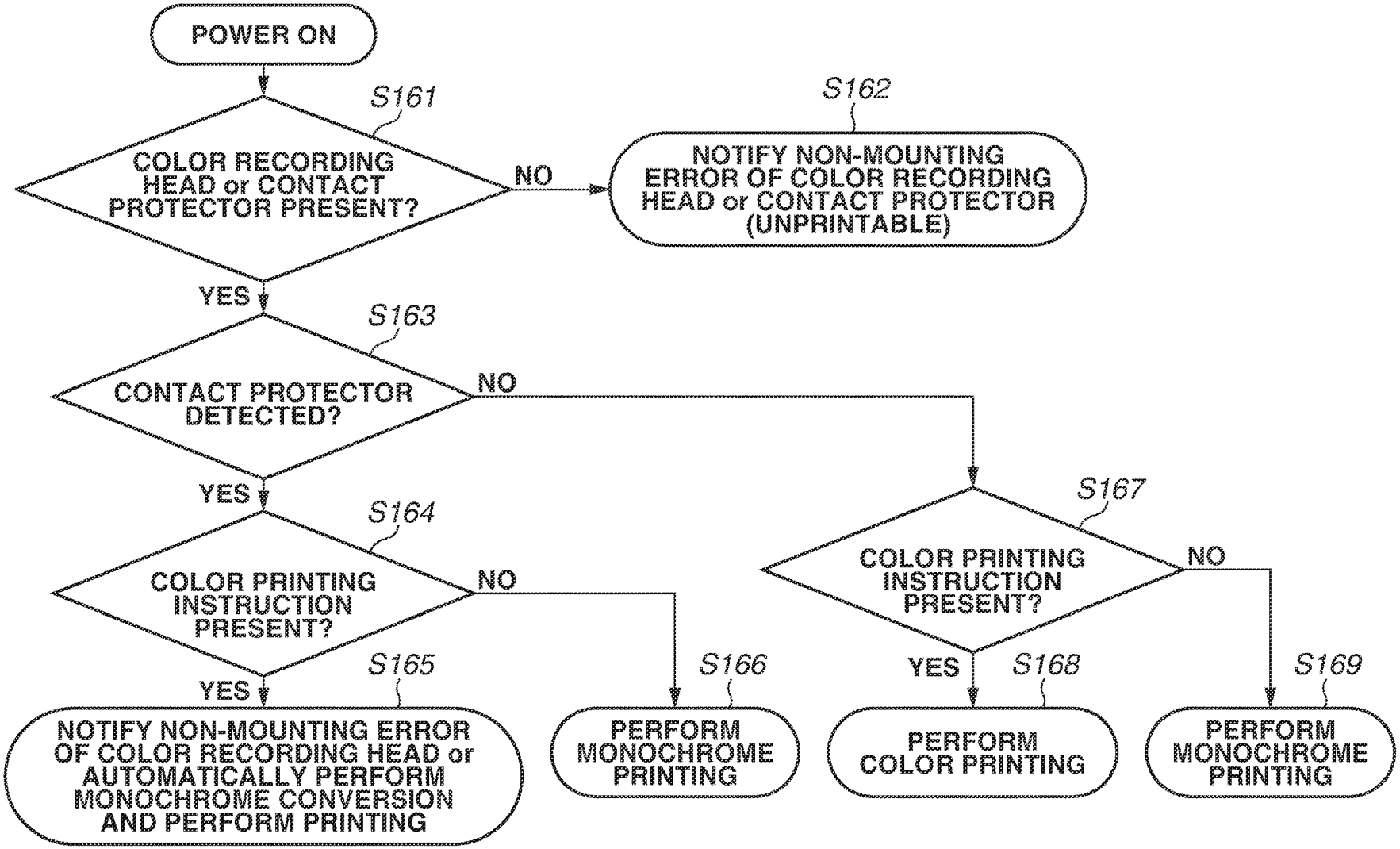
FIG. 16 is a flowchart illustrating operation of the inkjet recording apparatus after power is turned on according to the first exemplary embodiment.

FIG. 16 is a flowchart illustrating operation after the recording apparatus 1 is turned on. When the recording apparatus 1 is turned on, the MPU 201 detects an electric connection state of the connector 31*a* in step S161. In other words, the MPU 201 determines which of the contact protector 72 and the color recording head 101 has been mounted on the carriage 31.

In a case where non-mounting is detected (NO in step S161), the MPU 201 notifies the user of "cartridge non-mounting error" in step S162, and disables the recording operation by the recording unit 3. The "cartridge non-mounting error" may be notified by being displayed, for example, on a display panel of the operation unit 4 or on a screen of the host computer 214 via the printer driver 2141. Alternatively, a notification unit that performs notification by sound, etc. may be used.

In contrast, in a case where mounting is detected in step S161 (YES in step S161), the MPU 201 determines in step S163 which of the contact protector 72 and the color recording head 101 has been mounted. In a case where the contact protector 72 has been mounted (YES in step S163), the MPU 201 determines in step S164 whether a color printing instruction is present.

In a case where the color printing instruction is present (YES in step S164), the MPU 201 notifies "color cartridge non-mounting error" in step S165. The error notification in this case is also notified by being displayed on the display panel of the operation unit 4, on the screen of the host computer 214, or by sound. This can prompt the user to change the instruction to a monochrome printing instruction or to mount the color cartridge.

Alternatively, in step S166, the MPU 201 may function as a conversion unit to convert the image data to monochrome image data, and the monochrome printing may be performed by the black recording head 100. This improves usability by eliminating the necessity of reinput of the printing instruction by the user.

In contrast, in a case where mounting of the color recording head 101 is detected in step S163 (NO in step S163), it is determined in step S167 whether the color printing instruction is present. In a case of the color printing instruction (YES in step S167), the color printing is performed in step S168. In contrast, in a case of a monochrome printing instruction in step S167 (NO in step S167), the processing proceeds to step S169, and monochrome printing is performed.

As described above, in a case where it is determined in step S162 that neither the color recording head 101 nor the contact protector 72 have been mounted, the recording apparatus 1 cannot perform the recording operation. This prevents the recording operation from being performed while the connector 31*a* of the carriage 31 is exposed, and reduces electric contact failure caused by adhesion of the ink. Alternatively, after the error is notified in step S162, the user may select error cancellation to perform the recording operation in a state where neither the color recording head 101 nor the contact protector 72 are mounted.

Figure 17B:
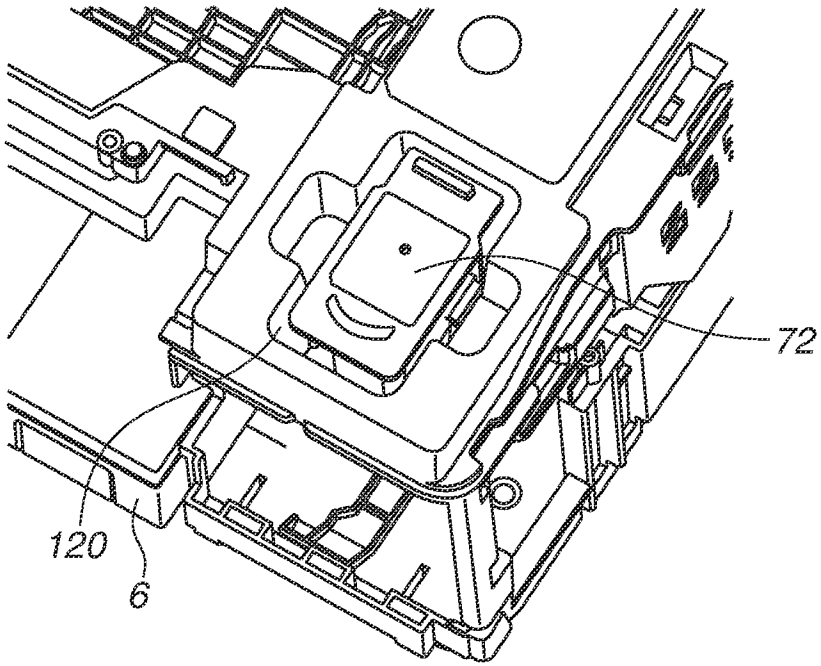
FIGS. 17A and 17B are diagrams each illustrating a storage portion of the contact protector in the inkjet recording apparatus according to the first exemplary embodiment.
Figure 17A:
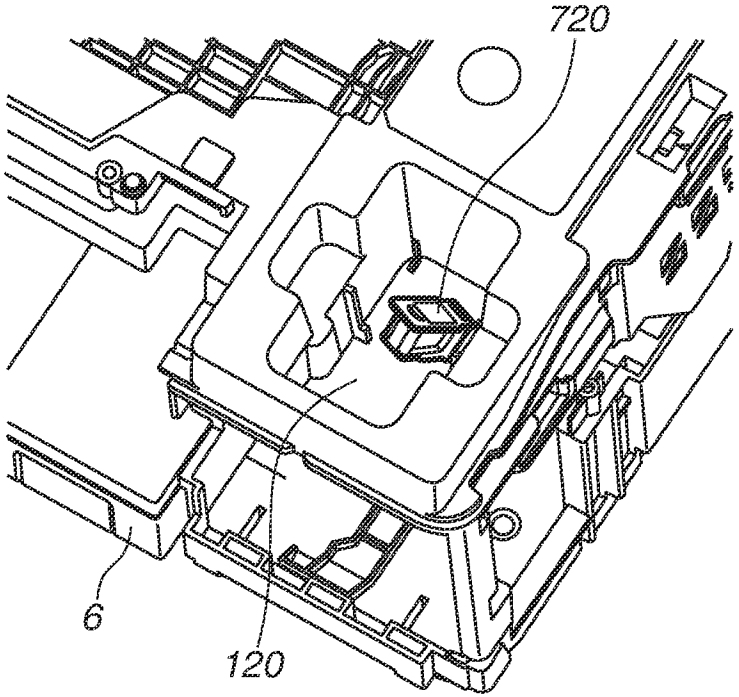

FIGS. 17A and 17B are enlarged perspective views illustrating storage of the contact protector 72 in the recording apparatus 1. The recording apparatus 1 includes a storage portion 120 at a position on the front surface of the apparatus and adjacent to the right side of the sheet feeding cassette 6. The contact protector 72 can be placed on and stored in the storage portion 120. The storage portion 120 is exposed when the scanner unit 2 is opened.

FIG. 17A illustrates a state where the contact protector 72 is not placed on the storage portion 120, and FIG. 17B illustrates a state where the contact protector 72 is placed on the storage portion 120. As illustrated in FIG. 17A, an illustration 720 of the contact protector 72 is drawn on a bottom surface of the storage portion 120, and guides the user to store the contact protector 72 in the storage portion 120.

As described with reference to FIG. 16, when neither the contact protector 72 nor the color recording head 101 is mounted on the carriage 31, the recording apparatus 1 cannot perform the recording operation. In a case where the user mounts the color recording head 101 on the carriage 31 in place of the contact protector 72, the user may lose the unused contact protector 72. In the present exemplary embodiment, providing the storage portion 120 in the recording apparatus 1 makes it possible to reduce the risk of the user losing the contact protector 72. Note that the color recording head 101 may be placed on the storage portion 120.

Next, the shape of the contact protector 72 and the shape of the color recording head 101 will be described in detail with reference to FIGS. 18A to 18D. In the present exemplary embodiment, the contact protector 72 and the color recording head 101 have substantially the same shape. This gives the user the same kind of usability in mounting the contact protector 72 and the color recording head 101 to the carriage 31, which makes it possible to improve usability.

Figure 18A:
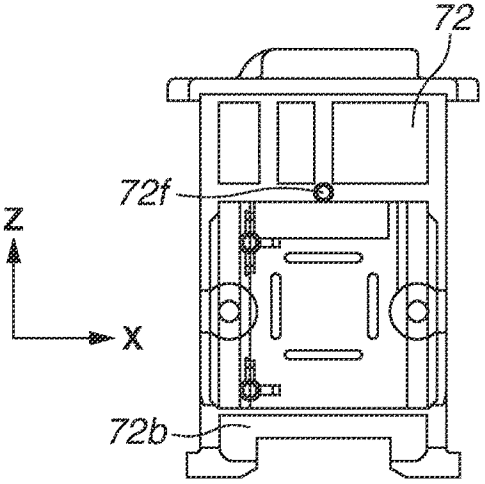
FIGS. 18A, 18B, 18C, and 18D are diagrams illustrating the contact protector and the color recording head according to the first exemplary embodiment.
Figure 18B:
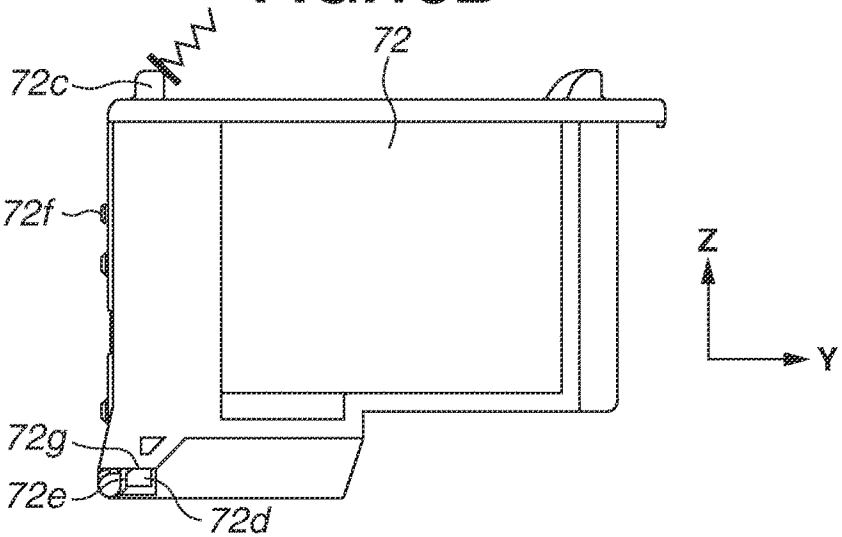
Figure 18C:
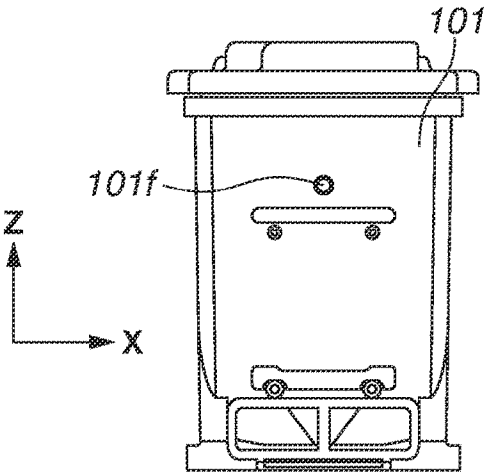
Figure 18D:
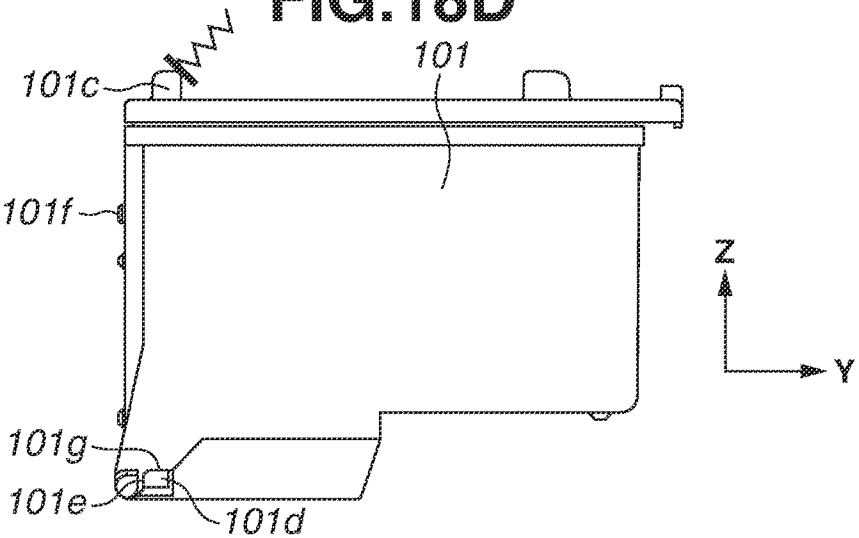

FIG. 18A is a front view of the contact protector 72, and FIG. 18B is a side view of the contact protector 72. FIG. 18C is a front view of the color recording head 101, and FIG. 18D is a side view of the color recording head 101. In FIGS. 18A to 18D, illustration of the substrate 72*a* of the contact protector 72 and the substrate of the color recording head 101 is omitted.

The contact protector 72 includes a plurality of positioning parts for positioning the contact protector 72 to the carriage 31. More specifically, the contact protector 72 includes a first positioning part 72*c* provided on an upper surface, a second positioning part 72*d* and a third positioning part 72*e* provided at a lower part, a fourth positioning part 72*f* provided on a side surface, and a fifth positioning part 72*g* provided on the lower part.

The first positioning part 72*c* is provided so as to abut on the second headset cover 33, and receives urging force by an urging member of the second headset cover 33. The first positioning part 72*c* is urged in a direction in which the contact protector 72 is positioned to the carriage 31. The second positioning part 72*d* positions the contact protector 72 to the carriage 31 in the X direction.

Further, the third positioning part 72*e* and the fourth positioning part 72*f* position the contact protector 72 to the carriage 31 in the Y direction. Further, the fifth positioning part 72*g* positions the contact protector 72 to the carriage 31 in the Z direction.

The color recording head 101 also includes a plurality of positioning parts that positions the color recording head 101 to the carriage 31, as with the contact protector 72. More specifically, the color recording head 101 includes a sixth positioning part 101*c* provided on an upper surface, a seventh positioning part 101*d* and an eighth positioning part 101*e* provided at a lower part, a ninth positioning part 101*f* provided on a side surface, and a tenth positioning part 101*g* provided at the lower part.

The sixth positioning part 101*c* corresponds to the first positioning part 72*c* of the contact protector 72, and the seventh positioning part 101*d* and the eighth positioning part 101*e* respectively correspond to the second positioning part 72*d* and the third positioning part 72*e*. Likewise, the ninth positioning part 101*f* corresponds to the fourth positioning part 72*f*, and the tenth positioning part 101*g* corresponds to the fifth positioning part 72*g*.

As described above, when the positioning of the contact protector 72 and the positioning of the color recording head 101 to the carriage 31 are made common, the user operation to mount the contact protector 72 to the carriage 31 and the user operation to mount the color recording head 101 to the carriage 31 are also made common, which improves usability.

Further, a weight of the contact protector 72 is within a range from a weight of the color recording head 101 when the ink tank of the color recording head is filled up with the ink to a weight of the color recording head 101 when no ink is present in the ink tank. Therefore, when either of the contact protector 72 and the color recording head 101 is mounted on the carriage 31, the weight of the carriage 31 is within a prescribed range. This eliminates necessity to change the driving control of the carriage 31.

In the above-described exemplary embodiment, the combination of one tube-supply-type recording head and one ink-cartridge-type recording head has been described as an example. The exemplary embodiment is applicable to a combination in which the number of tube-supply-type recording heads or the number of ink-cartridge-type recording heads is two or more, and similar effects are achievable.

Other Embodiments

Figure 19:
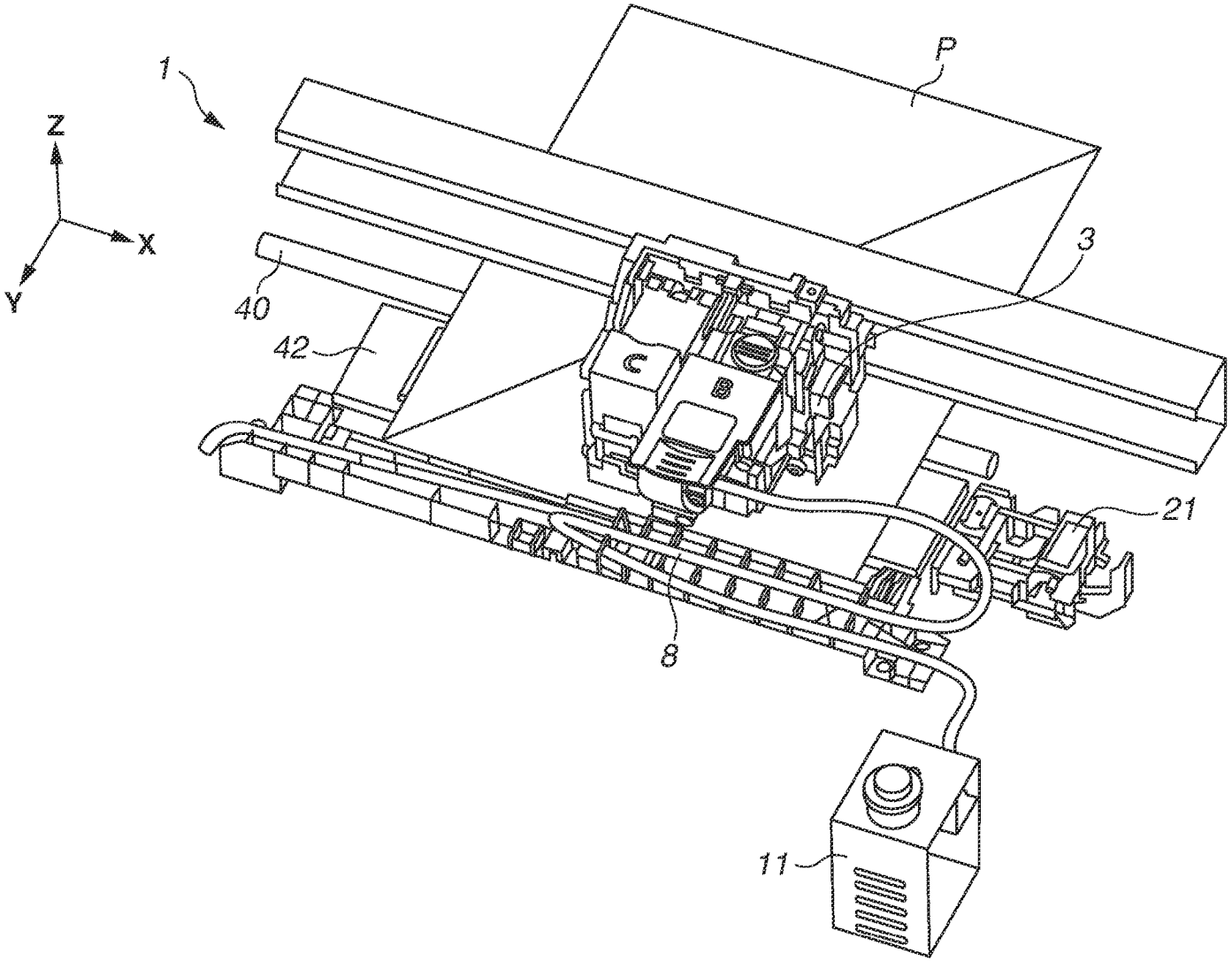
FIG. 19 is a perspective view illustrating an internal configuration of an inkjet recording apparatus according to another exemplary embodiment.

FIG. 19 illustrates another exemplary embodiment. In the first exemplary embodiment, the configuration in which the recovery unit and the ink tank 11 are disposed separately from each other in the main scanning direction has been described. The exemplary embodiment, however, is applicable to a configuration in which the ink tank 11 is disposed on the side same as the recovery unit (cap 21) in the main scanning direction as illustrated in FIG. 19.

The supply tube 8 connected to the ink tank 11 is laid in a direction (upstream in X direction) separating from the recovery unit in the main scanning direction, and is then folded back and is laid toward the opposite direction (downstream in X direction). Further, as with the first exemplary embodiment, the supply tube 8 is bent upward in the X direction on the side provided with the recovery unit in the main scanning direction, and is connected to the recording unit 3. As described above, in the exemplary embodiment, the position to dispose the ink tank 11 is not limited.

Further, the configuration including the injection portion 14 to inject the ink into the ink tank 11 has been described, however, the configuration is not limited thereto. The ink tank 11 is applicable to a cartridge that is detachable from the recording apparatus 1.

According to the exemplary embodiments, it is possible to provide the inkjet recording apparatus that can prevent contact failure between the carriage and the ink cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2019-072549, filed Apr. 5, 2019, and No. 2019-072550, filed Apr. 5, 2019, which are hereby incorporated by reference herein in their entirety.

What is claimed is:

1. An inkjet recording apparatus configured to perform recording operation by ejecting ink at least from a first recording head, comprising:

an ink tank configured to contain the ink to be supplied to the first recording head;

a tube configured to connect the first recording head and the ink tank; and a carriage including a first mounting portion on which the first recording head is mounted, a second mounting portion on which a second recording head is detachably mounted, and a contact portion electrically connected to the second recording head, and configured to reciprocate, wherein a protection member protecting the contact portion can be detachably mounted on the second mounting portion.

2. The inkjet recording apparatus according to claim 1, further comprising a detection unit configured to detect electric connection between the contact portion and one of the second recording head and the protection member, wherein, in a case where the detection unit detects that neither the second recording head nor the protection member is mounted on the second mounting portion, the recording operation by the recording head is not performed.

3. The inkjet recording apparatus according to claim 2, further comprising a notification unit configured to notify error in the case where it is detected that neither the second recording head nor the protection member is mounted on the second mounting portion.

4. The inkjet recording apparatus according to claim 3, wherein the notification unit notifies the error in a case where color printing instruction is received in a state where the detection unit detects that the protection member is being mounted.

5. The inkjet recording apparatus according to claim 1, further comprising a recovery unit disposed outside a recording area where the recording operation is performed, and configured to perform recovery operation to maintain ejection performance of the first recording head and the second recording head.

6. The inkjet recording apparatus according to claim 5, wherein the recovery unit includes a wiper wiping an ejection port surface of the recording head, and wherein the wiper and the protection member do not abut on each other in a state where the protection member is mounted on the second mounting portion.

7. The inkjet recording apparatus according to claim 5, wherein the recovery unit includes a cap sealing an ejection port surface of the recording head, and wherein the protection member includes a shielding part shielding the cap in a state where the protection member is mounted on the second mounting portion.

8. The inkjet recording apparatus according to claim 1, wherein the second recording head and the protection member are positioned to the second mounting portion by a common positioning part of the second mounting portion.

9. The inkjet recording apparatus according to claim 1, wherein the second recording head is integrated with an ink tank containing ink.

10. The inkjet recording apparatus according to claim 9, wherein a weight of the protection member is between a first weight of the second recording head in a state where the ink tank of the second recording head is filled up with the ink and a second weight of the second recording head in a state where no ink is present in the ink tank.

11. The inkjet recording apparatus according to claim 1, wherein the first recording head ejects black ink supplied from the ink tank, and the second recording head ejects color ink.

12. The inkjet recording apparatus according to claim 11, further comprising:

a detection unit configured to detect electric connection between the contact portion and one of the second recording head and the protection member; and a conversion unit configured to convert recorded data into monochrome recorded data in a case where color printing instruction is received in a state where the detection unit detects that the protection member is being mounted.

13. The inkjet recording apparatus according to claim 1, further comprising a storage portion configured to store the protection member or the second recording head.

14. The inkjet recording apparatus according to claim 13, further comprising a cover configured to be openable and closable to the apparatus, wherein the storage portion is provided at a position to be exposed when the cover is opened.

15. The inkjet recording apparatus according to claim 1, wherein the ink tank includes an injection portion to which the ink is injected from an ink bottle.

16. A protection member used in an inkjet recording apparatus configured to perform recording operation by ejecting ink at least from a first recording head, the inkjet recording apparatus including an ink tank configured to contain the ink to be supplied to the first recording head, a tube configured to connect the first recording head and the ink tank, and a carriage including a first mounting portion on which the first recording head is mounted, a second mounting portion on which a second recording head is detachably mounted, and a contact portion electrically connected to the second recording head, and configured to reciprocate, wherein the protection member is detachably mounted on the second mounting portion and protects the contact portion in a state of being mounted on the second mounting portion.

* * * * *